US010130229B2

(12) United States Patent
Smith

(10) Patent No.: US 10,130,229 B2
(45) Date of Patent: Nov. 20, 2018

(54) EFFICIENT SURFACE TREATING MACHINE

(71) Applicant: Yale Merret Smith, San Rafael, CA (US)

(72) Inventor: Yale Merret Smith, San Rafael, CA (US)

( * ) Notice: Subject to any disclaimer, the term of this patent is extended or adjusted under 35 U.S.C. 154(b) by 411 days.

(21) Appl. No.: 14/868,216

(22) Filed: Sep. 28, 2015

(65) Prior Publication Data

US 2016/0015234 A1 Jan. 21, 2016

Related U.S. Application Data

(63) Continuation-in-part of application No. 14/022,229, filed on Sep. 10, 2013, now Pat. No. 9,386,896, and a continuation-in-part of application No. 13/852,514, filed on Mar. 28, 2013, now Pat. No. 9,420,931.

(60) Provisional application No. 62/056,722, filed on Sep. 29, 2014.

(51) Int. Cl.

| | |
|---|---|
| ***A47L 11/12*** | (2006.01) |
| ***A47L 11/284*** | (2006.01) |
| ***A47L 11/40*** | (2006.01) |
| ***A47L 11/28*** | (2006.01) |
| ***B08B 1/00*** | (2006.01) |
| *B24B 23/04* | (2006.01) |

(52) U.S. Cl.

CPC ..... *A47L 11/12* (2013.01); *A47L 11/28* (2013.01); *A47L 11/284* (2013.01); *A47L 11/4036* (2013.01); *A47L 11/4069* (2013.01); *A47L 11/4086* (2013.01); *B08B 1/00* (2013.01); *B24B 23/04* (2013.01)

(58) Field of Classification Search

CPC ..... A47L 11/10; A47L 11/12; A47L 11/28; A47L 11/284; A47L 11/4036; A47L 11/4038; A47L 11/4063; A47L 11/4069; B24B 23/00; B24B 23/04

USPC ..... 15/49.1, 50.1, 50.2, 52.2, 98; 451/350, 451/351, 356, 357

See application file for complete search history.

(56) References Cited

U.S. PATENT DOCUMENTS 1,700,115 A 1/1929 Thompson
3,416,177 A * 12/1968 Young ..... A47L 11/12 15/98

(Continued)

FOREIGN PATENT DOCUMENTS

DE 2306925 * 8/1974
DE 3243973 * 5/1984

(Continued)

*Primary Examiner* — Mark Spisich
(74) *Attorney, Agent, or Firm* — David E Lovejoy

(57) ABSTRACT

A machine for treating a surface lying in an XY plane. The machine includes a body, a body plate, a cleaning plate, a drive assembly and an attachment assembly. The cleaning plate is located between the body plate and the XY plane. The drive assembly is connected to the cleaning plate to drive the cleaning plate with a cleaning vibration in an oscillating pattern parallel to the XY plane. The attachment assembly flexibly attaches the cleaning plate to the body plate to permit the cleaning plate to vibrate relative to the body plate and to isolate the cleaning vibration from the body. A connector is attached to the body for connecting to a member, such as a handle, to move the machine in the XY plane.

19 Claims, 16 Drawing Sheets

(56) References Cited

U.S. PATENT DOCUMENTS

| | | | | | |
|---|---|---|---|---|---|
| 3,445,877 | A * | 5/1969 | Stout | A47L 11/12 | 15/22.1 |
| 4,686,797 | A * | 8/1987 | Hoffman | B24B 23/043 | 15/22.1 |
| 4,974,371 | A * | 12/1990 | Conboy | B24B 7/184 | 403/114 |
| 5,394,585 | A | 3/1995 | Connelly | | |
| 6,179,696 | B1 * | 1/2001 | Duffy | B24B 23/03 | 451/357 |
| 7,210,185 | B2 | 5/2007 | Paas | | |
| 7,565,712 | B2 * | 7/2009 | Long | A47L 11/065 | 15/22.2 |
| 8,578,540 | B2 | 11/2013 | Byrne | | |
| 2004/0040579 | A1 * | 3/2004 | Smith | A47L 11/12 | 134/6 |
| 2004/0103490 | A1 * | 6/2004 | Long | A47L 11/125 | 15/22.1 |
| 2004/0107522 | A1 | 6/2004 | Paas | | |
| 2006/0059640 | A1 | 3/2006 | Hornsby et al. | | |

FOREIGN PATENT DOCUMENTS

| | | | |
|---|---|---|---|
| DE | 3510333 | * | 9/1986 |
| EP | 1714739 | * | 10/2006 |
| GB | 1449925 | * | 9/1976 |
| GB | 2086216 | * | 5/1982 |
| JP | 2013-220493 | * | 10/2013 |
| WO | 82/01923 | * | 6/1982 |
| WO | 97/02111 | * | 1/1997 |
| WO | WO2012078145 | | 6/2012 |

* cited by examiner

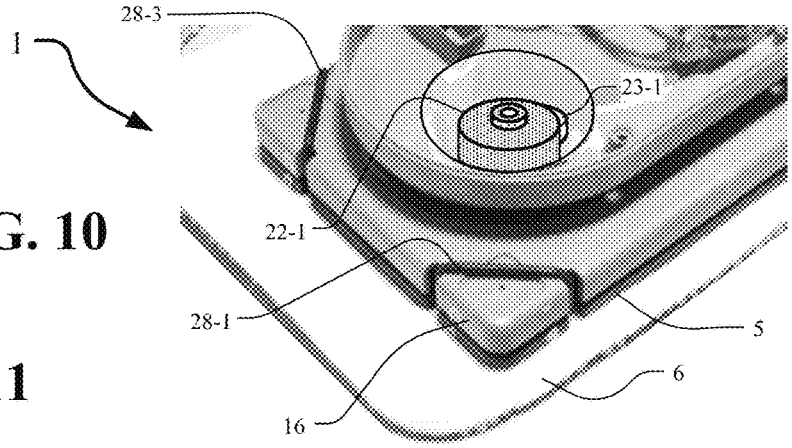
FIG. 10
FIG. 11
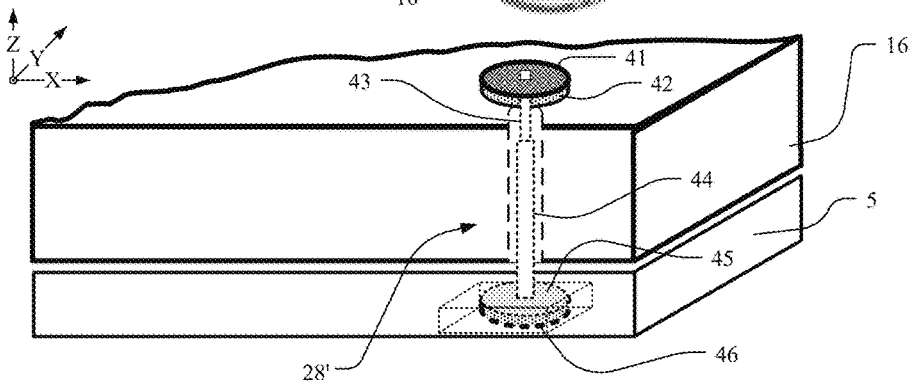
FIG. 12
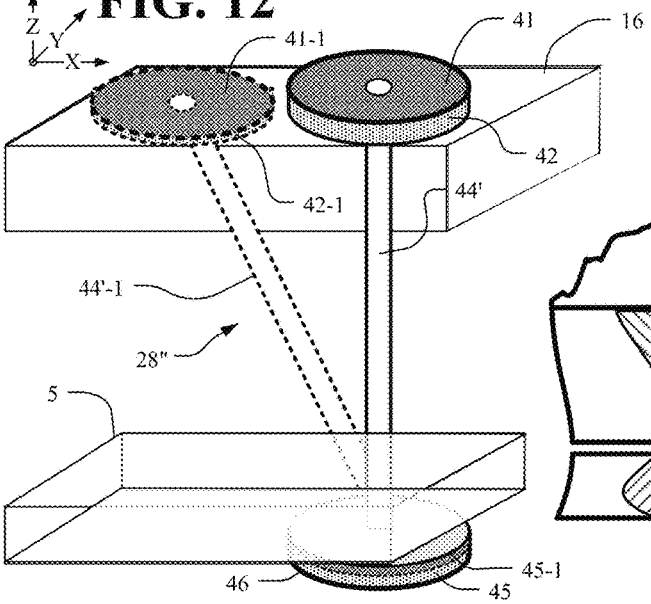
FIG. 13
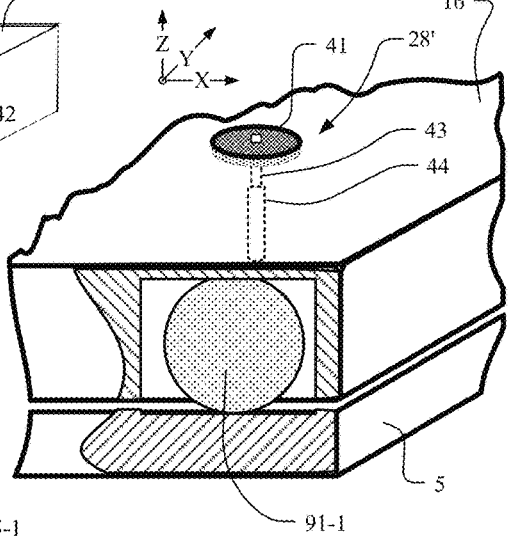

EFFICIENT SURFACE TREATING MACHINE

This application is a continuation in part of application Ser. No. 14/022,229, filed Sep. 10, 2013, now U.S. Pat. No. 9,386,896, which is a continuation in part of application Ser. No. 13/852,514, filed Mar. 28, 2013, now U.S. Pat. No. 9,420,931, and claims the benefit of U.S. provisional Application No. 62/056,722, filed Sep. 29, 2014.

BACKGROUND OF THE INVENTION

This invention relates to a machine for treating work surfaces such as floors formed of carpet, tile, wood and other materials. The most efficient and effective surface treatments employ a vibration, "scrubbing", motion to loosen materials on the work surface. On floors and other work surfaces, a machine typically uses a cleaning towel, "pad", in combination with a solvent, including water or steam, and/or a cleaning agent. When the cleaning towel scrubs the floor and becomes dirty, the towel is replaced with a clean one.

In US Patent publication 20070107150 A1 having inventor Yale Smith and published May 17, 2007, a Carpet Cleaning Apparatus And Method With Vibration, Heat, And Cleaning Agent is described. In that patent publication, a combination of vibratory motion, controllable heat, and cleaning agents are used. The apparatus includes a base cleaning plate, heating elements with electrical connections, and means for moving the cleaning plate to produce a scrubbing motion.

Important attributes of surface treating machines are cleaning effectiveness, ease of use, convenience, stability, light weight, low machine wear, long life and ease of maintenance. These attributes are import for machines used by professionals in heavy duty environments or used by other consumers in home or other light duty environments.

Cleaning effectiveness requires that machines include a small oscillation that creates a local vibration in a cleaning plate to impart a "scrubbing" movement to the surface being treated. For cleaning floors, the local vibration is preferably in a range of several millimeters. Cleaning effectiveness and convenience requires that the shape of the cleaning plate be rectangular so as to be readily used along straight edges and easily moved into rectangular corners. In order to satisfy these attributes, machines with round bottom plates are undesirable.

Ease of use and convenience require stability, appropriate size and weight and ease of operator control. Designs that position the motor and drive assembly high above the cleaning plate are undesirable since such configurations tend to accentuate vertical instability. Vertical instability results in unwanted oscillation of the cleaning plate up and down in a mode that is in and out of the plane of the work surface. The plane of the work surface is referred to as the floor surface plane or the XY-plane. Vertical instability is distinguished from horizontal oscillations providing local vibration to impart a "scrubbing" movement to the cleaning plate. The horizontal oscillations are parallel to the plane of the work surface, that is, parallel to the XY-plane. Vertical instability is additionally undesirable because it uses excessive amounts of energy, reduces the energy efficiency of the machine and causes increased wear on the motor, the dive shafts, the drivers and the drive bushings. The increased wear increases maintenance and decreases the life of the machine. User fatigue is dramatic when unwanted vertical oscillations occur.

High energy efficiency is an important attribute. For machines powered by an AC electrical service through an AC-to-DC converter or powered by a battery, the size and cost of the motor is a function of the energy requirements needed to drive the transmission and the cleaning plate. For DC motors, the energy requirements are important for the motor and for the AC-to DC converter used to convert the AC electrical service to DC. The more energy efficient the machines, the smaller and less expensive are the AC-to-DC converters, batteries and motors required to power the machines.

Another factor in cleaning effectiveness is determined by the material of the machine in contact with the floor material. Brushes are not absorbent and therefore are inefficient in removing solid and liquid matter from a floor. For existing machines that use a towel, the towels are typically synthetic and do not absorb and hold solid and liquid matter from a floor. For towels that are primarily cotton, they have the disadvantage of not scrubbing well and also have high friction with the floor surface resulting in low energy efficiency.

In light of the above background, it is desirable to have improved surface treatment machines for treating carpets, tiles, wood and other surface materials.

SUMMARY

The present invention is a machine for treating a surface lying in an XY plane. The machine includes a body, a body plate, a cleaning plate, a drive assembly and an attachment assembly. The cleaning plate is located between the body plate and the XY plane. The drive assembly is connected to the cleaning plate to drive the cleaning plate with a cleaning vibration in an oscillating pattern parallel to the XY plane. The attachment assembly flexibly attaches the cleaning plate to the body plate under compression to permit the cleaning plate to vibrate relative to the body plate and to isolate the cleaning vibration from the body.

In one embodiment, a connector is attached to the body for connecting to a member, such as a handle, to move the machine in the XY plane.

In one embodiment, the attachment assembly includes a plurality of compression devices connected between the cleaning plate and the body for urging the cleaning plate and the body toward each other. The compression devices are, for example, O-rings, springs, elastic bands or cushioned shaft connectors. The attachment assembly includes a plurality of rolling separators, such as ball bearings, under pressure from the compression devices for separating the cleaning plate and the body plate.

In one embodiment, the cushioned shaft connectors have first and second ends where the first end includes a first end cap and a first compression washer for engaging the body plate in compression and the second end includes a second end cap and a second compression washer for engaging the cleaning plate in compression. Under oscillation of the cleaning plate, the first end cap and the first compression washer and the second end cap and the second compression washer apply increasing pressure at extremes of travel of the cleaning plate during cleaning oscillations thereby tending to limit the oscillation range of the cleaning plate.

In one embodiment, the drive assembly includes a motor and power supply such as a DC motor and a battery. The motor has a stator fixed to the cleaning plate and has a rotor for rotating on a motor axis about the stator. An offset weight is attached to one section of the rotor and is rotated asymmetrically by the rotor around the motor axis so as to cause a vibration of the motor and the attached cleaning plate. The cleaning plate is thus driven with a vibration in an oscillating pattern parallel to the XY plane.

In one embodiment, the drive assembly includes a first motor apparatus and a second motor apparatus. The first motor apparatus includes a first stator fixed to the cleaning plate, a first rotor for rotating in a first direction about the first stator and about a first motor axis, and a first offset weight attached to the first rotor and rotated by the first rotor around the first motor axis whereby the cleaning plate is driven with a first vibration in a first oscillating pattern parallel to the XY plane. The second motor apparatus includes a second stator fixed to the cleaning plate, a second rotor for rotating in a second direction about the second stator and about a second motor axis, and a second offset weight attached to the second rotor and rotated by the second rotor around the second motor axis whereby the cleaning plate is driven with a second vibration in a second oscillating pattern parallel to the XY plane. The cleaning plate has a combined vibration formed by the combination of the first vibration pattern and the second vibration pattern.

In embodiments, the first direction is clockwise and the second direction is counterclockwise.

In one embodiment, the drive assembly includes a synchronizer, such as mechanical gears or an electronic network, for synchronizing the rotation of the first rotor and the second rotor whereby the first offset weight and the second offset weight are maintained at synchronized rotational angles.

In one embodiment, the first rotor and the second rotor have a first phase angle and a second phase angle, respectively, for the first offset weight and for the second offset weight, respectively, measured on an axis normal to a direction of travel of the machine, and the synchronizer operates to maintain the first phase angle and the second phase angle substantially the same.

In one embodiment, where the synchronizer includes an electronic network, the network includes a first sensor for sensing the position of the first rotor with a first position signal, a second sensor for sensing the position of the second rotor with a second position signal, a controller responsive the first position signal and the second position signal to drive the first motor and the second motor whereby the first offset weight and the second offset weight are maintained in synchronism at the same rotational angle.

In one embodiment, the cleaning plate includes a cleaning towel attached to the cleaning plate.

In one embodiment, the connector connects to a handle whereby a user grasping the handle can move the machine over a floor lying in the XY plane.

The foregoing and other objects, features and advantages of the invention will be apparent from the following detailed description in conjunction with the drawings.

BRIEF DESCRIPTION OF THE DRAWINGS

FIG. 10 depicts a corner perspective view of one O-ring embodiment of the compression device providing compression between the body and the cleaning plate of the surface treating machine of FIG. 1 and FIG. 2.

FIG. 11 depicts a schematic corner perspective and schematic view of another embodiment of the compression device providing compression between the body and the cleaning plate.

FIG. 12 depicts a perspective view of another compression device similar to the compression device shown in FIG. 11.

FIG. 13 depicts a cutaway perspective view of the compression device, the body and the cleaning plate of FIG. 11.

DETAILED DESCRIPTION

Figure 1:
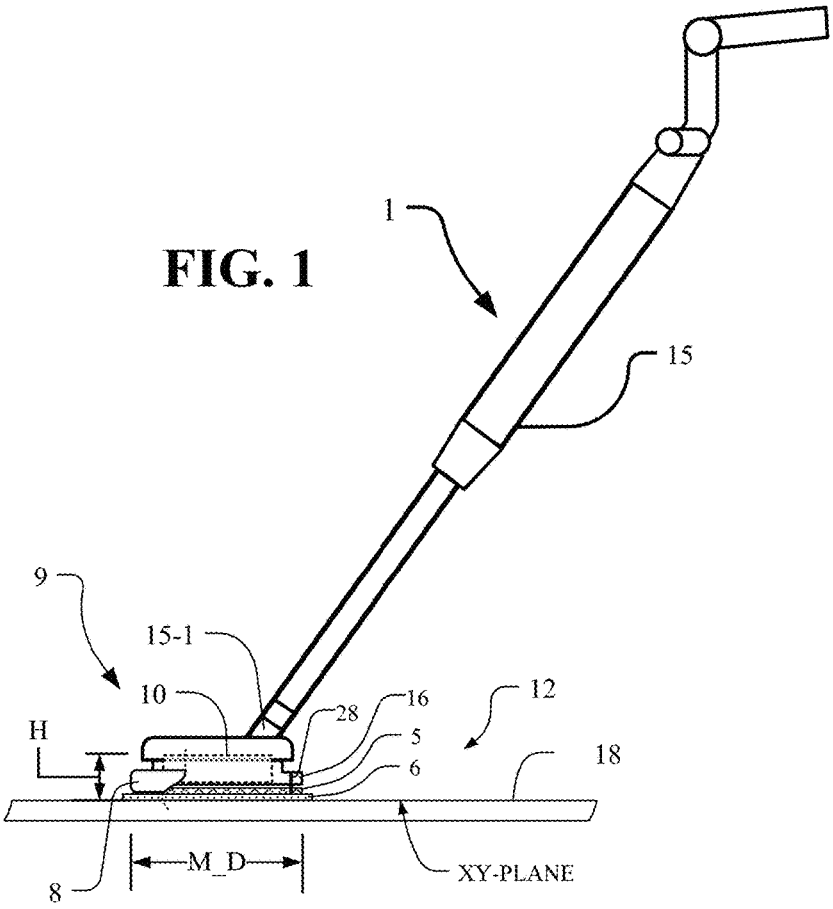
FIG. 1 depicts a side view of one embodiment of a surface treating machine on a surface to be treated.

In FIG. 1, a surface treating machine 1 includes a body 9, a drive assembly 10 and a cleaning plate assembly 12. A body plate 16 is rigidly attached to and is a part of the body 9. The cleaning plate assembly 12 is driven by the drive assembly 10 for cleaning or polishing the floor surface 18 lying in a floor plane denominated as the XY-plane. The cleaning plate assembly 12 includes a cleaning plate 5 and a cleaning pad 6. In some embodiments, the machine 1 includes a skirt 8 attached as part of the body 9 and superimposed over and around the cleaning plate assembly 12.

In FIG. 1, the machine 1 includes a handle assembly 15 affixed to the body 9 for enabling a user to guide machine 1 over a floor surface lying in the XY-plane. The handle assembly 15 has a length extending from the body 9 at a variable angle with the XY-plane and connected to the body by a connector 15-1. The handle assembly 15 is rotationally attached to body 9 and adjusts to acute angles with the cleaning surface when in use for cleaning. The handle assembly 15 includes a latch (not shown) for latching the handle assembly 15 in the vertical position for transport and storage of the machine 1 when not in operation.

The drive assembly 10 has a drive assembly height dimension, H, measured from the XY-plane. The cleaning plate assembly 12 typically has a length and a width lying in the XY-plane of the floor surface. The smaller one of the length and the width dimensions, or the only dimension if the length and width are equal, of the cleaning plate assembly 12 is the minimum treatment dimension, M_D. In order to provide stability for the machine 1, the height dimension, H, typically is less than 0.25 of the minimum treatment dimension, M_D. A low drive assembly height dimension is important in minimizing or preventing unwanted vertical instability. Vertical instability results in unwanted oscillation of the cleaning plate up and down in a mode that is in and out of the XY-plane, the plane of the work surface 18. Such unwanted oscillations are a complex function of the floor surface material and movements of the machine during operation as well as the design of the machine. For normal and intended operation, the machine is operating with oscillations in the XY-plane of the floor surface. When the machine is moved from location to location on a floor by a machine operator, some forces out of the XY-plane inherently result. If the drive assembly 10 height dimension, H, is too high, these forces out of the XY-plane tend to accumulate in intensity reaching a resonant vibration frequency identified as vertical instability. Such vertical instability can be difficult to control by an operator and is wasteful of energy. In some embodiments, the vertical instability is minimized or eliminated by having the drive assembly height dimension, H, less than 0.25 of the minimum treatment dimension, M_D.

Figure 2:
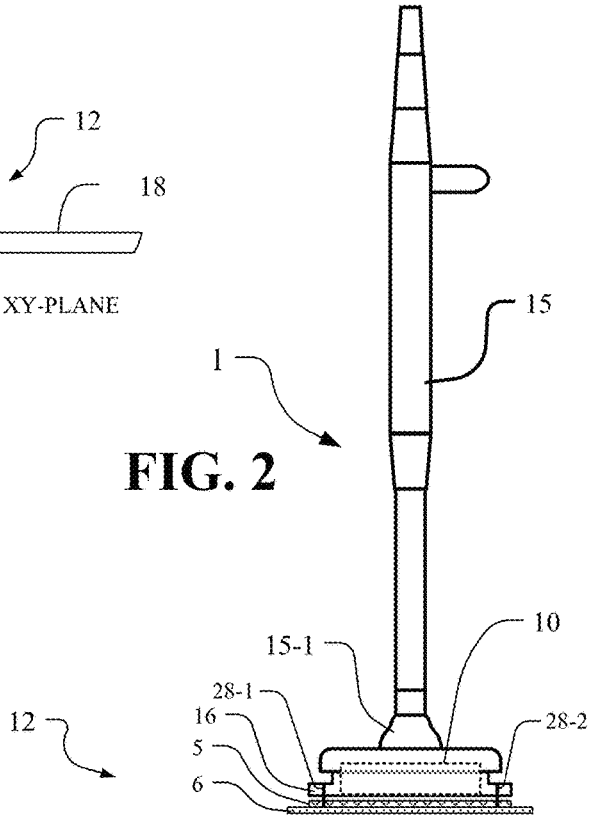
FIG. 2 depicts a front view of the surface treating machine of FIG. 1.

In FIG. 2, a front view of the surface treating machine 1 of FIG. 1 is shown. The surface treating machine 1 includes a body 9 with a handle assembly 15. The handle assembly 15 is shown latched in the upright position. The cleaning plate assembly 12 is driven by a drive assembly 10 in the body 9 in an oscillating pattern. A body plate 16 is part of and rigidly attached to the body 9. The cleaning plate assembly 12 includes a cleaning plate 5 and a cleaning pad 6.

Figure 3:
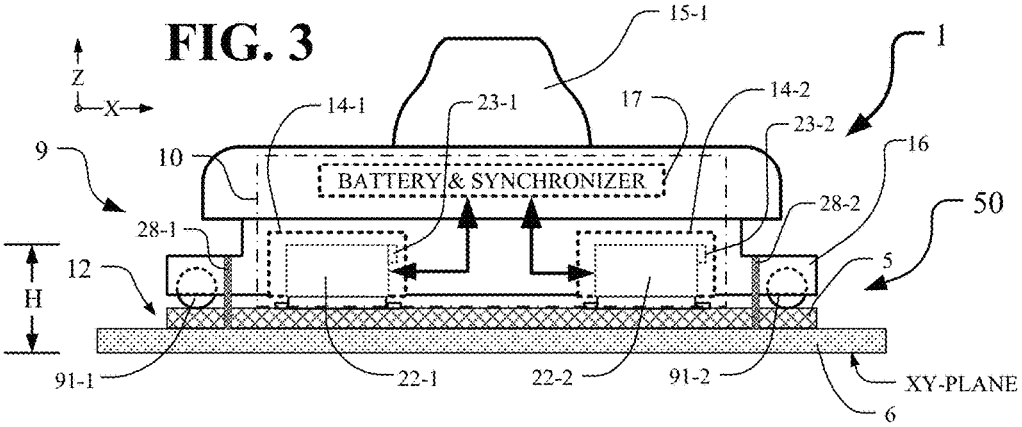
FIG. 3 depicts a schematic front view with further details of one embodiment of the motors in the drive assembly and the cleaning plate assembly of the machine of FIG. 1 and FIG. 2.

In FIG. 3, a front view with further details of one embodiment of the drive assembly 10, the body plate 16 and the cleaning plate assembly 12 of FIG. 1 is shown. The drive assembly 10 includes motors 22-1 and 22-2 directly connected to the cleaning plate 5. The motors 22-1 and 22-2 include off-set weights 23-1 and 23-2, respectively. The off-set weights 23-1 and 23-2 cause the cleaning plate 5 and the attached cleaning pad 6 to oscillate in the XY-plane, that is, in the plane parallel to the floor. The body plate 16 is separated from the cleaning plate 5 by ball bearings 91-1 and 91-2. The compression devices 28-1 and 28-2 urge the body plate 16 and the cleaning plate 5 toward each other while the ball bearings 91-1 and 91-2 hold the body plate 16 and the cleaning plate 5 apart. The ball bearings 91-1 and 91-2 allow the body plate 16 and the cleaning plate 5 to slide parallel to each other parallel to the XY-plane thereby allowing the cleaning plate to oscillate parallel to the XY-plane.

The motors 22-1 and 22-2 are connected to the cleaning plate 5 and are not connected to the body plate 16 or any other part of the body 9. The body 9 includes openings 14-1 and 14-2 into which the motors 22-1 and 22-2 extend without contacting the body 9. The motors 22-1 and 22-2 preferably have a small dimension in the Z-axis direction normal to the XY-plane. In one embodiment, the motors 22-1 and 22-2 have a Z-axis dimension of 1.1 inches (28 millimeters). In FIG. 3, the body plate 16 and the cleaning plate 5, in one typical embodiment, measure approximately 12 inches (30.5 cm) by 6.5 inches (16.5 cm) when viewed parallel to the XY-plane. In order to provide stability for the machine 1, the height dimension, H, of approximately 40 millimeters is much less than 0.25 of the minimum treatment dimension, M_D of 16.5 centimeters (see FIG. 4). With an H/M_D ratio of 4/16.5 which is equal to approximately 0.24, the machine 1 of FIG. 3 is very stable with no noticeable Z-axis instability.

In FIG. 3, a battery and synchronizer unit 17 provides synchronized battery power to drive the motors 22-1 and 22-2. With synchronized operation, the weights 23-1 and 23-2 are maintained in predetermined rotational directions by operation of the electrical signals to and from the motors 22-1 and 22-2. In operation, the first offset weight 23-1 and the second offset weight 23-2 are maintained at synchronized rotational angles. Synchronized rotational angles are angles that are repeatedly the same for each revolution of the motors. For example, when the first offset weight 23-1 is at 90° and the second offset weight 23-2 is also at 90° for each revolution, then the first offset weight 23-1 and the second offset weight 23-2 are at synchronized rotational angles. The synchronized rotational angles can be any values. By way of further example, the first offset weight 23-1 can be at 0° and the second offset weight 23-2 can be at 180° for each revolution. When the rotational angles differ during different revolutions, the first offset weight 23-1 and the second offset weight 23-2 are maintained at unsynchronized rotational angles. For example, when the first offset weight 23-1 is at 90° and the second offset weight 23-2 is also at 90° for one revolution and the first offset weight 23-1 is at 90° and the second offset weight 23-2 is 75° for another revolution, the first offset weight 23-1 and the second offset weight 23-2 are at unsynchronized rotational angles.

In FIG. 3, the motors 22-1 and 22-2, in one typical embodiment, are 12 pole HobbyKing Donkey ST3508-730 KV outrunner motors. Such motors typically operate with a maximum voltage of 15 volts and with a maximum current of 35 amps. The total height of such motors are 28 mm and revolutions per minute (RPM) at a typical 6 volts of operation is approximately 4100 rpm.

In FIG. 3, the attachment assembly 50 includes a plurality of compression devices, like compression devices 28-1 and 28-2, connected between the cleaning plate 5 and the body plate 16 for urging the cleaning plate 5 and the body plate 16 toward each other. The compression devices like devices 28-1 and 28-2 are, for example, O-rings, springs, elastic bands or cushioned shaft connectors. The compression devices 28-1 and 28-2 in the embodiment of FIG. 3 are O-rings. The attachment assembly 50 includes a plurality of rolling separators, such as ball bearings 91-1 and 91-2, under pressure from the compression devices 28-1 and 28-2 for separating the cleaning plate 5 and the body plate 16.

Figure 4:
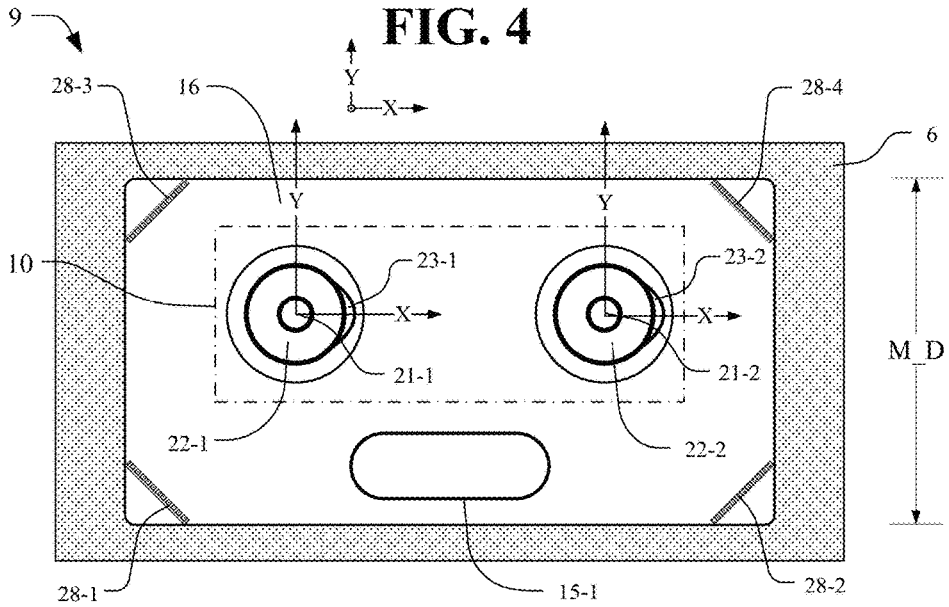
FIG. 4 depicts a schematic top view of the apparatus of FIG. 3.

In FIG. 4, a schematic top view of the machine 1 of FIG. 3 is shown. The drive assembly 10 includes motors 22-1 and 22-2 directly connected to the cleaning plate 5. The motors 22-1 and 22-2 include center axes 21-1 and 21-2 about which the rotors (not explicitly shown) of the motors rotate. The motors 22-1 and 22-2 include off-set weights 23-1 and 23-2, respectively. The off-set weights 23-1 and 23-2 cause the attached cleaning pad 6 to oscillate in the XY-plane, that is, in the plane parallel to the floor by operation of the cleaning plate 5 (as described in connection with FIG. 3). The compression devices 28-1, 28-2, 28-3 and 28-4 are O-rings and urge the body plate 16 toward the cleaning plate 5 (as shown in FIG. 3 for compression devices 28-1 and 28-2). The handle connector 15-1 is provided for connecting a handle to the body 9. Typically, the machine 1 is pushed forward, during surface cleaning or other surface treatment, in the Y-axis direction in the XY-plane. As shown in FIG. 4, both of the off-set weights 23-1 and 23-2 at one instance in time are oriented in, or are parallel to, the X-axis direction and hence are defined to have a 0° X-axis orientation. The X-axis direction is normal to the Y-axis direction, that is, normal to the direction of travel. When the motors are rotating, then the off-set weights 23-1 and 23-2 become oriented, at different instances of time, at all the angles from 0° to 360°.

The embodiment of FIG. 3 and FIG. 4 is a machine 1 for treating a surface lying in an XY plane. The machine 1 has a body 9 having a body plate 16, has a cleaning plate 5 located between the body plate 16 and the XY plane, has a drive assembly 10 connected to the cleaning plate 5 to drive the cleaning plate 5 with a cleaning vibration in an oscillating pattern parallel to the XY plane. The machine 1 has an attachment assembly 50 for flexibly attaching the cleaning plate 5 to the body plate 16 under compression to permit the cleaning plate 5 to vibrate relative to the body plate 16 and to isolate the cleaning vibration from the body. The compression between the cleaning plate 5 and the body plate 16 is applied by the attachment assembly 50. The attachment assembly 50 includes a plurality of compression devices 28 connected between the cleaning plate 5 and the body plate 16 for urging the cleaning plate 5 and the body plate 16 toward each other. The attachment assembly 50 includes a plurality of rolling separators, such as ball bearings 91, under pressure from the compression devices 28 for separating the cleaning plate 5 and the body plate 16.

Figure 5:
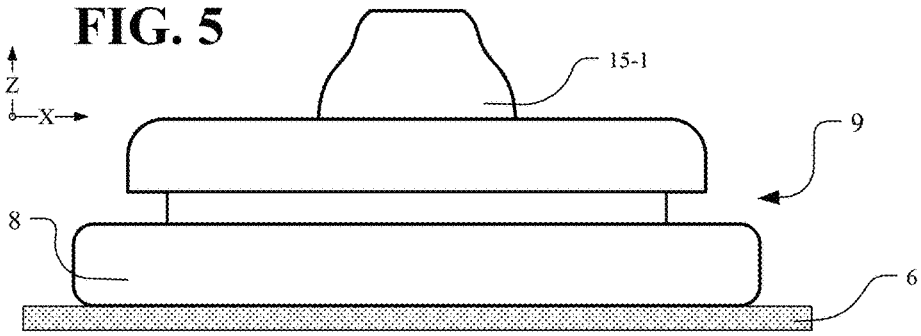
FIG. 5 depicts a front view of the body, the skirt and the cleaning pad for the surface treating machine of FIG. 1 and FIG. 2.

In FIG. 5, a front view of the machine 1 of FIG. 3 is shown and includes handle connector 15-1, the body 9, the skirt 8 and the cleaning pad 6.

Figure 6:
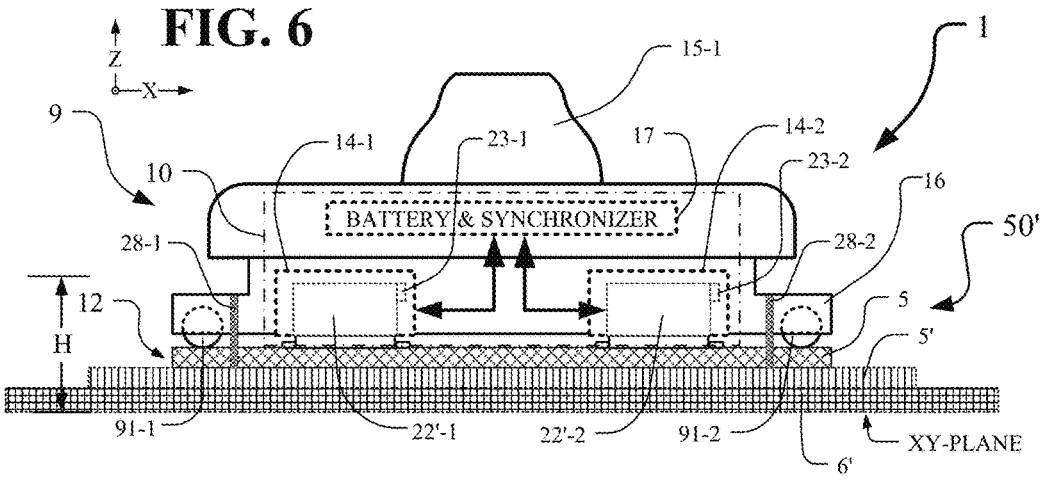
FIG. 6 depicts a schematic front view with further details of another embodiment of the motors in the drive assembly and the cleaning plate assembly of the machine of FIG. 1 and FIG. 2.

In FIG. 6, a front view with further details of another embodiment of a surface treating machine 1 is shown. The machine 1 of FIG. 6 includes a drive assembly 10, a body plate 16 and a cleaning plate assembly 12 of the type described in connection with FIG. 1, FIG. 2 and FIG. 3. The drive assembly 10 includes motors 22'-1 and 22'-2 directly connected to the cleaning plate 5. The motors 22'-1 and 22'-2 include off-set weights 23-1 and 23-2, respectively. A cleaning plate extender 5' is attached to the cleaning plate 5. The cleaning plate extender 5' has dimension which are larger than the dimensions of the cleaning plate 5 so that a cleaning pad 6' can be accommodated. The cleaning plate 6' is substantially larger than the cleaning plate 6. The cleaning plate extender 5', in one embodiment, attaches to the cleaning plate 5 using Velcro® or other attachment means in the same manner that the cleaning pad 6 attaches to the cleaning plate 5 in FIG. 3. The cleaning plate 6', in one embodiment, attaches to the cleaning plate extender 5' using Velcro® or other attachment means in the same manner that the cleaning pad 6 attaches to the cleaning plate 5 in FIG. 3.

In FIG. 6, the off-set weights 23-1 and 23-2 cause the cleaning plate 5, the cleaning plate extender 5' and the attached cleaning pad 6' to oscillate in the XY-plane, that is, in the plane parallel to the floor. The body plate 16 is separated from the cleaning plate 5 by ball bearings 91-1 and 91-2. The compression devices 28-1 and 28-2 urge the body plate 16 and the cleaning plate 5 toward each other while the ball bearings 91-1 and 91-2 hold the body plate 16 and the cleaning plate 5 apart. The ball bearings 91-1 and 91-2 allow the body plate 16 and the cleaning plate 5, and the cleaning plate extender 5' to slide parallel to each other in the XY-plane thereby allowing the cleaning plate 5, cleaning plate extender 5' and the cleaning pad 6' to oscillate in the XY-plane.

Figure 7:
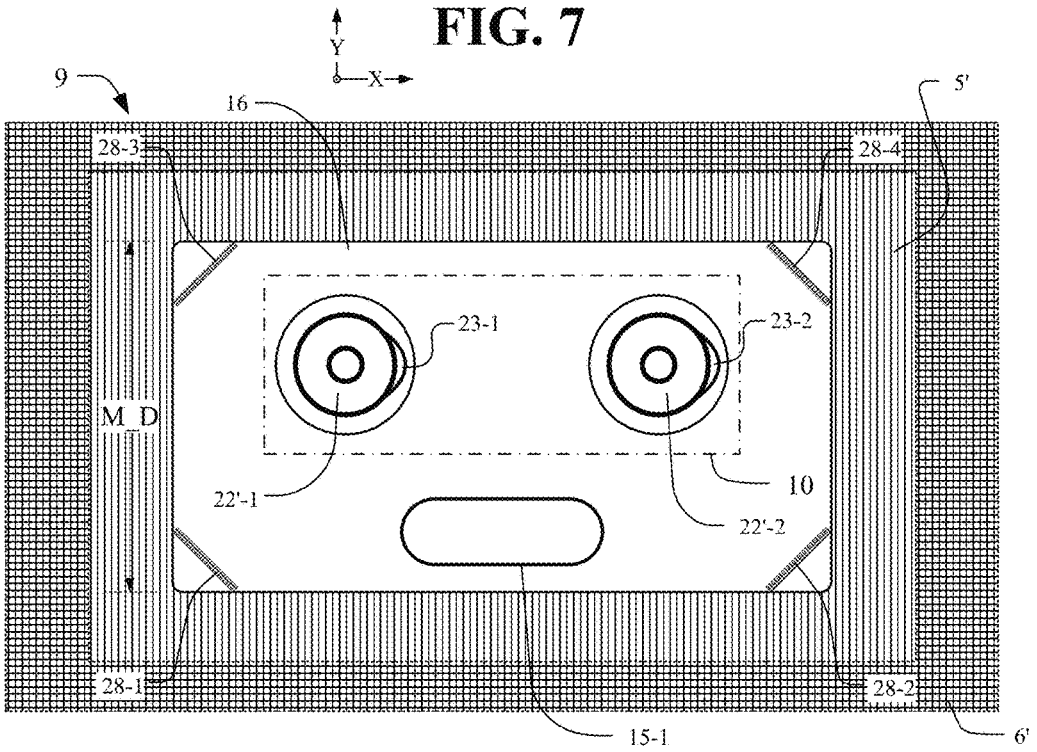
FIG. 7 depicts a schematic top view of the machine of FIG. 6.

The larger cleaning pad 6' is advantageously driven by larger motors 22'-1 and 22'-2. One typical motor for the motors 22-1 and 22-2 of FIG. 6 is a Turnigy Multistarr 4822-390 KV, 22 pole outrunner motor which operates with a maximum voltage of 22 volts and with a maximum current of 15 amps. The total height of such motor is 28 mm and revolutions per minute (RPM) range from 2500 to 5000 RPM. In a typical 12 volts operation, the motors run at approximately 4200 rpm. In FIG. 7, a schematic top view of the machine 1 of FIG. 6 is shown. The drive assembly 10 includes motors 22'-1 and 22'-2 directly connected to through the cleaning plate 5 (see FIG. 6) to the cleaning plate extender 5'. The motors 22'-1 and 22'-2 include off-set weights 23-1 and 23-2, respectively. The off-set weights 23-1 and 23-2 cause the cleaning plate extender 5' and an attached cleaning pad 6' to oscillate in the XY-plane, that is, in the plane parallel to the floor by operation of the oscillation of the cleaning plate 5 (as described in connection with FIG. 6). The compression devices 28-1, 28-2, 28-3 and 28-4 urge the body plate 16 toward the cleaning plate 5 (as shown in FIG. 6 for compression devices 28-1 and 28-2). The handle connector 15-1 is provided for connecting a handle to the body 9. The motors 22'-1 and 22'-2 in FIG. 6 and FIG. 7 can be the same size as the motors in FIG. 3 or alternatively may have greater power for driving the larger cleaning pad 6'.

In FIG. 6, the body plate 16 and the cleaning plate 5, in one typical embodiment, measure approximately 12 inches (30.5 cm) by 6.5 inches (16.5 cm) when viewed parallel to the XY-plane. In one typical embodiment, the cleaning plate 5' measures approximately 14 inches (35.5 cm) by 8 inches (20 cm) when viewed parallel to the XY-plane. In order to provide stability for the machine 1, the height dimension, H, of approximately 40 millimeters is much less than 0.25 of the minimum treatment dimension, M_D of 16.5 centimeters (see FIG. 4). With an H/M_D ratio of 4/20 which is equal to approximately 0.2, the machine 1 of FIG. 3 is very stable with no noticeable Z-axis instability.

Figure 8:
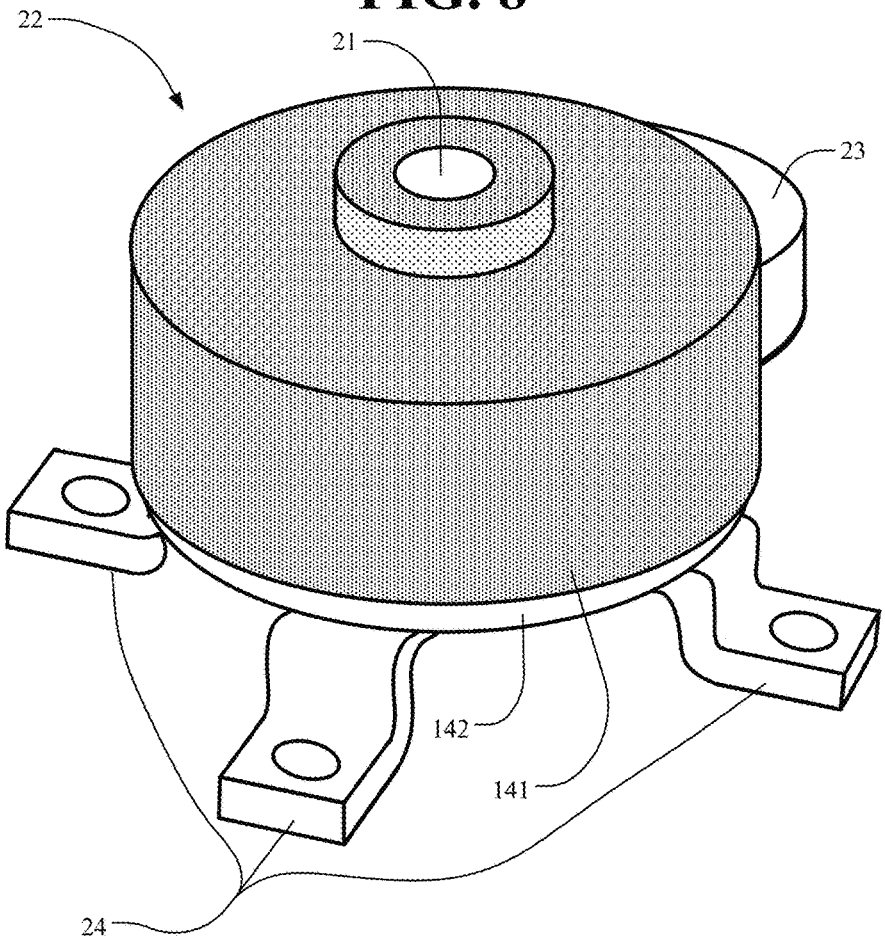
FIG. 8 depicts a perspective schematic view of a typical motor of the type shown in FIG. 4.

In FIG. 8, a perspective schematic view of a typical motor 22 of the type shown in FIG. 3 and FIG. 4 is shown. The motor 22 includes a rotor 141 that rotates about a motor axis defined by a central shaft 21 and about the stator 142. The stator 142 includes legs 24 for mounting the motor and specifically the stator 142. The rotor 141 has an offset weight 23 attached so that when the rotor turns an oscillation tends to occur.

Figure 9:
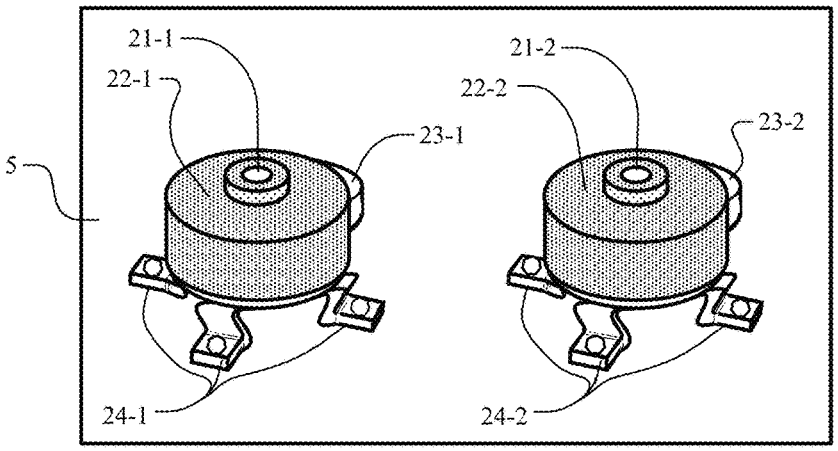
FIG. 9 depicts a perspective view of two motors and supports of the FIG. 8 type attached to a cleaning plate.

In FIG. 9, a perspective view of two motors 22-1 and 22-2 of the FIG. 8 type are attached to a cleaning plate 5 by the feet 24-1 and 24-2, respectively.

In FIG. 10, a corner perspective view of one embodiment of a machine 1 is shown with the compression devices 28-1 and 28-3 providing compression between the body plate 16 and the cleaning plate 5. The motor 22-1 has the offset weight 23-1. The compression devices 28-1 and 28-3 are O-ring or other elastic material providing compression between the body plate 16 and the cleaning plate 5 while still having sufficient flexibility to allow the body plate 16 and the cleaning plate 5 to slide relative to each other and thereby permit the cleaning plate 5 to oscillate. When the cleaning plate 5 vibrates relative to the body plate 16, the compression devices 28-1 and 28-3 are stretched and apply increased compression tending to restrict movement of the cleaning plate 5 relative to the position of the body plate 16. The increased compression tends to limit the travel of the cleaning plate 5 relative to the body plate 16. Typically, the amplitude of the vibration is between 1 millimeter and 4 millimeters.

In FIG. 11, a schematic corner perspective view of another embodiment of a compression device 28' is shown providing compression between the body plate 16 and the cleaning plate 5. The compression device 28' has end caps 41 and 46 formed of metal or other rigid material. The end cap 41 has a plastic or other elastic washer 42 which pushes under compression against a surface of the body plate 16. The end cap 46 has a plastic or other elastic washer 45 which pushes under compression against a surface of the cleaning plate 16. A rigid connector 43 extends from the end cap 41 and engages a rigid connector 44 extending from the end cap 46. In one embodiment, the connectors 43 and 44 are threaded so that by turning one into the other the space between ends 41 and 46 can be adjusted and hence the initial compression applied between the body plate 16 and the cleaning plate 5 is adjusted to the desired amount. When the cleaning plate 5 vibrates relative to the body plate 16, the shafts 43 and 44 are tilted and the end caps 41 and 46 are also tilted so as to apply increased pressure on the washers 42 and 45. As the offset of the position of the cleaning plate 5 increases relative to the position of the body plate 16, the tilt of the shafts 43 and 44 increases and the compression forces against the elastic washers 42 and 45 increases. The increased compression tends to limit the travel of the cleaning plate 5 relative to the body plate 16.

In FIG. 12, a perspective view of another compression device 28" is shown providing compression between the body plate 16 and the cleaning plate 5. The compression device 28" has end caps 41 and 46 formed of metal or other rigid material. The end cap 41 has a plastic or other elastic washer 42 which pushes under compression against a surface of the body plate 16. The end cap 46 has a plastic or other elastic washer 45 which pushes under compression against a surface of the cleaning plate 16. A non-stretching connector 44' extends from the end cap 41 to the end cap 46. In one embodiment, the connector 44' is a fixed length which initially establishes the compression applied between the body plate 16 and the cleaning plate 5 when installed in the surface treating machine. When the cleaning plate 5 vibrates relative to the body plate 16, the shaft 44' bends, and assumes a new position 44'-1 (which is exaggerated for descriptive purposes), without lengthening causing the end caps 41 and 46 to apply increased pressure on the washers 42 and 45. The end caps 41 and 46, unlike in FIG. 11, do not tilt when the shaft 44' moves to the position of 44'-1 so that compression of the end caps 41 and 46 against the washers 42 and 45 is more uniform. As the offset of the position of the cleaning plate 5 increases relative to the position of the body plate 16, the compression forces against the elastic washers 42 and 45 increase. The increased compression tends to limit the travel of the cleaning plate 5 relative to the body plate 16.

In FIG. 13, a cutaway perspective view of the compression device 28' of FIG. 11 is shown. As described in connection with FIG. 11, the compression device 28' urges the body plate 16 toward the cleaning plate 5. The ball bearing 91-1 is held firmly in place between the body plate 16 and the cleaning plate 5. In cooperation with the compression device 28', the ball bearing 91-1 assists in providing a low friction interface between the body plate 16 and the cleaning plate 5 permitting oscillation of the cleaning plate 5 relative to the body plate 16. Since the ball bearing 91-1 is held compressed between the cleaning plate 5 and the body plate 16, unwanted oscillations in the Z-axis vertical direction normal to the XY-plane of the floor are avoided or minimized.

In FIG. 13, part of the attachment assembly 50 (see FIG. 3 and FIG. 4) includes a compression device 28' connected between the cleaning plate 5 and the body plate 16 for urging the cleaning plate 5 and the body plate 16 toward each other. The attachment assembly 50 includes a rolling separator, in the form of ball bearings 91-1 under pressure from the compression device 28' for separating the cleaning plate 5 and the body plate 16.

Figure 14:
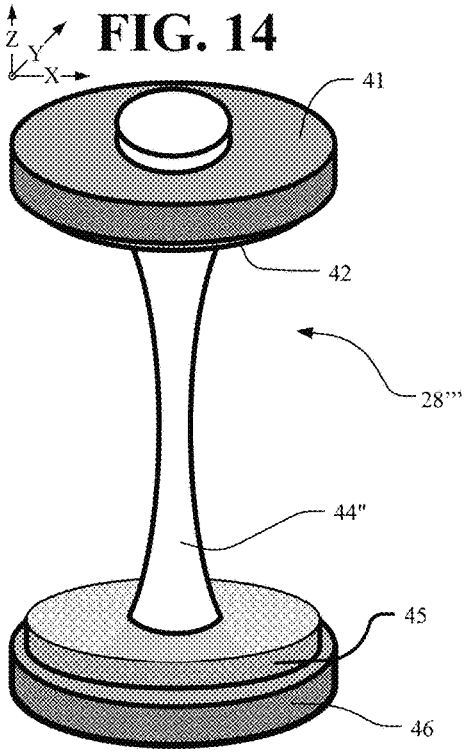
FIG. 14 depicts a perspective view of another compression device.

In FIG. 14, a perspective view of another compression device 28''' is shown. The compression device 28''' has end caps 41 and 46 formed of metal or other rigid material. The end cap 41 has a plastic or other elastic washer 42 which pushes under compression against a surface of the body plate 16 of FIG. 11. The end cap 46 has a plastic or other elastic washer 45 which pushes under compression against a surface of the cleaning plate 16 of FIG. 11. A connector 44" extends from the end cap 41 to the end cap 46. In one embodiment, the connector 44" is a fixed length and non-stretching which initially establishes the compression applied between the body plate 16 and the cleaning plate 5 (see FIG. 11) when installed in the surface treating machine. The compression device 28''' differs from the compression device 28" of FIG. 12 in that the shaft 44" of FIG. 14 tapers to a narrower diameter than the shaft 44' of FIG. 12 and is more flexible and bends when the cleaning plate 5 oscillates.

Figure 15:
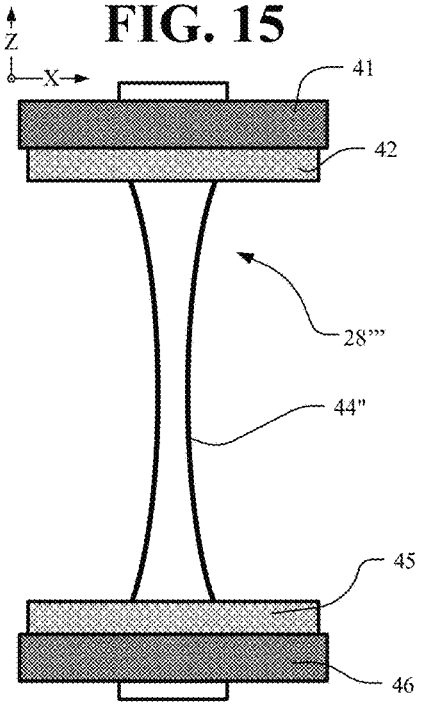
FIG. 15 depicts a front view of the compression device of FIG. 14.

In FIG. 15, a front view of the compression device 28''' of FIG. 14 is shown. The compression device 28''' has end caps 41 and 46 formed of metal or other rigid material. The end cap 41 has a plastic or other elastic washer 42 which pushes under compression against a surface of the body plate 16 (see FIG. 11). The end cap 46 has a plastic or other elastic washer 45 which pushes under compression against a surface of the cleaning plate 16 (see FIG. 11). A connector 44" extends from the end cap 41 to the end cap 46. In one embodiment, the connector 44" is a fixed length and non-stretching which initially establishes the compression applied between the body plate 16 and the cleaning plate 5 (see FIG. 11) when installed in the surface treating machine. The compression device 28''' differs from the compression device 28" of FIG. 12 in that the shaft 44" of FIG. 14 tapers to a narrower diameter than the shaft 44' of FIG. 12 and is more flexible and bends when the cleaning plate 5 oscillates.

Figure 16:
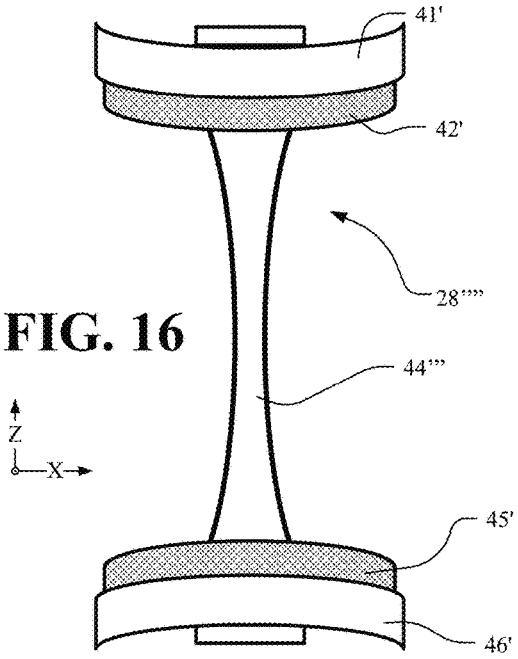
FIG. 16 depicts a front view of another embodiment of the compression device of FIG. 14.

In FIG. 16, a front view of an alternate embodiment of the compression device 28''' of FIG. 15 is shown. The compression device 28'''' has end caps 41' and 46' formed of metal or other rigid material. The end caps 41' and 46' have a slight curvature that tracks with the curvature encountered when the shaft 44''' tilts during oscillation of the cleaning plate 5 (see FIG. 11). The end cap 41' has a plastic or other elastic washer 42' which pushes under compression against a surface of the body plate 16 (see FIG. 11). The elastic washer 42' conforms to the curvature of the end cap 41'. The end cap 46' has a plastic or other elastic washer 45' which pushes under compression against a surface of the cleaning plate 16 (see FIG. 11). The elastic washer 45' conforms to the curvature of the end cap 46'. A connector 44" extends from the end cap 41' to the end cap 46'. In one embodiment, the connector 44" is a fixed length and non-stretching which initially establishes the compression applied between the body plate 16 and the cleaning plate 5 (see FIG. 11) when installed in the surface treating machine. The compression device 28'''' differs from the compression device 28" of FIG. 12 in that the shaft 44" of FIG. 14 tapers to a narrower diameter than the shaft 44' of FIG. 12 and is more flexible and bends when the cleaning plate 5 oscillates. The curved end caps 41' and 46' and the conforming elastic washer 42' and 45' help to insure that the oscillation of the cleaning plate 5 (see FIG. 11) is smooth.

Figure 17:
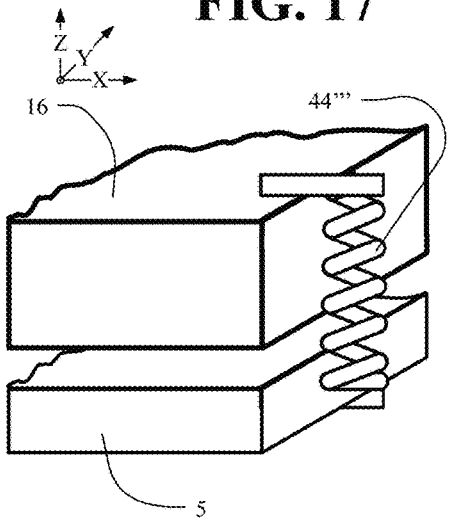
FIG. 17 depicts a perspective view of another compression device providing compression between the body and the cleaning plate.

In FIG. 17, a perspective view of another compression device 44''' is shown which provides compression between the body plate 16 and the cleaning plate 5. The compression device 44''' is a conventional metal extension spring or alternatively is a rubber or other non-metallic elastic material.

Figure 18:
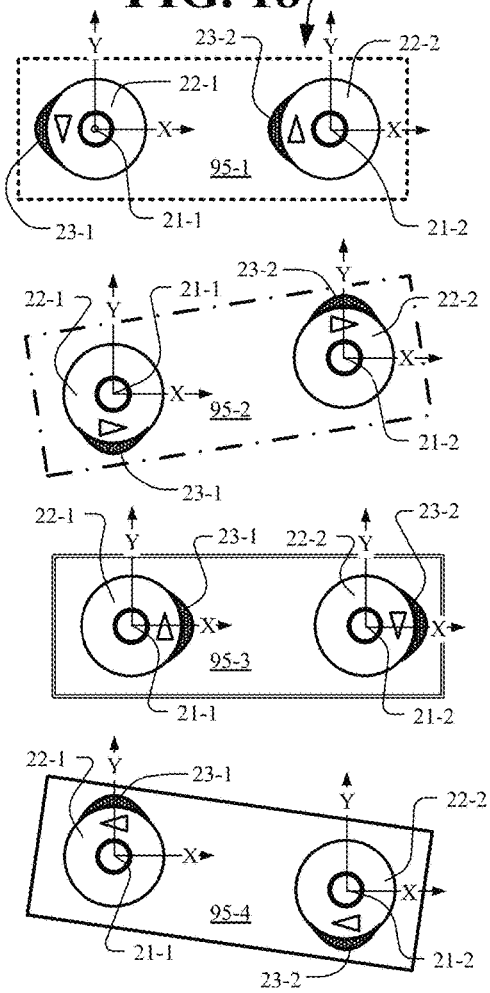
FIG. 18 depicts four different positions, shown by way of example, of the cleaning plate when two motors are synchronized and are rotating in opposite directions.

In FIG. 18, shifted top views of four different positions are shown of the cleaning plate 5 according to the FIG. 3 and FIG. 4 machine 1. The four different positions are designated 95-1, 95-2, 95-3 and 95-4 and are representative of the many different positions of machine 1 when undergoing vibration. In FIG. 18, the rotors of the motors 22-1 and 22-2 are rotating in opposite directions as shown by the triangle symbol. In embodiments such as FIG. 18 with the counter rotation of the motors 22-1 and 22-2, the cleaning action is particularly suitable for hard surfaces such as wood floors and rugs with short piles and loops. A 2 millimeter oscillation has been found suitable for a machine having a minimum treatment dimension, M_D, of 6.5 inches (see FIG. 1). In general, oscillations between 1 and 4 millimeters work well.

As shown in FIG. 18, both of the off-set weights 23-1 and 23-2 at one instance in time are oriented as shown in view 95-1 parallel to the X-axis direction at an angle of 180°. The X-axis direction is normal to the Y-axis direction, that is, normal to the direction of travel.

In FIG. 18, the off-set weights 23-1 and 23-2 at another instance of time are oriented as shown in view 95-2 with the weight 23-1 at 270° with respect to the X-axis and with the weight 23-2 at 90° with respect to the X-axis.

In FIG. 18, the off-set weights 23-1 and 23-2 at another instance of time are oriented as shown in view 95-3 with the weight 23-1 at 0° with respect to the X-axis and with the weight 23-2 at 0° with respect to the X-axis.

In FIG. 18, the off-set weights 23-1 and 23-2 at another instance of time are oriented as shown in view 95-4 with the weight 23-1 at 90° with respect to the X-axis and with the weight 23-2 at 270° with respect to the X-axis.

When the rotors of the motors are rotating, then the off-set weights 23-1 and 23-2 become oriented, at different instances of time, at all the angles from 0° to 360° where the views 95-1, 95-2, 95-3 and 95-4 are examples. The off-set weights 23-1 and 23-2 in FIG. 18 are synchronized in that the angular orientation over many rotations of the off-set weights 23-1 and 23-2 through 360° remains the same. Further, off-set weights 23-1 and 23-2 in FIG. 18 are synchronized and phased to be substantially at the same angle in the X-axis direction, that is, synchronized and phased to be substantially at the same angle in the direction normal (at right angles) to the direction of travel. Specifically, in the orientation of view 95-1, the off-set weights 23-1 and 23-2 are both at an angle of 180° with respect to the X-axis. Specifically, in the orientation of view 95-3, the offset weights 23-1 and 23-2 are both at an angle of 0° with respect to the X-axis. While the examples of the orientations of view 95-1 and 95-3 have equal phase angles, that is, 180° and 0°, very good performance is achieved when the phase angles are approximately within +/−10° of each other. For example, the off-set weight 23-1 might be at 20° when the off-set weight 23-1 is at 0°.

Figure 19:
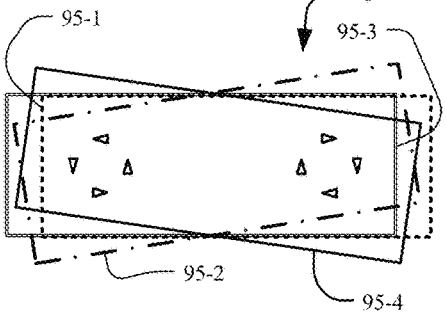
FIG. 19 depicts a top view of the four different positions of the cleaning plate when the two motors are synchronized rotating in opposite directions as shown in FIG. 18.

In FIG. 19 a non-shifted top view of the four different representative positions of FIG. 18 are shown for the cleaning plate 5. According to FIG. 19, the FIG. 10 and FIG. 14 transmissions drive through the four different positions designated 95-1, 95-2, 95-3 and 95-4.

Figure 20:
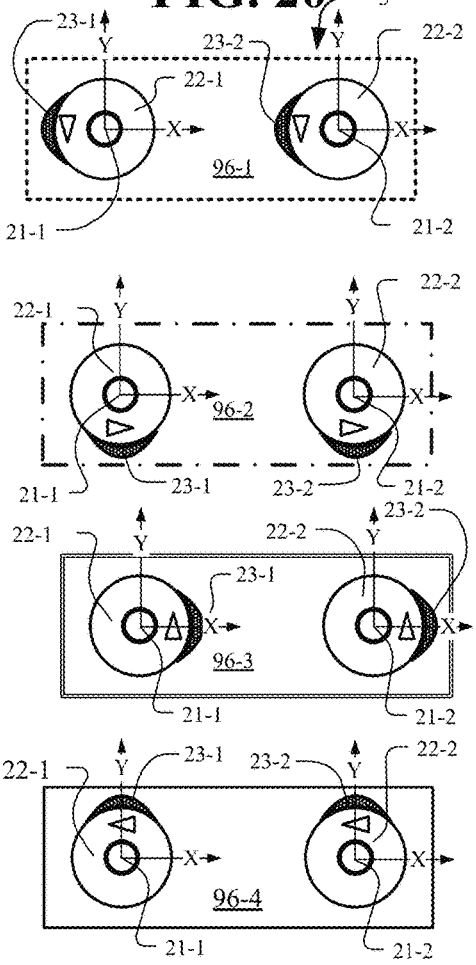
FIG. 20 depicts four different positions, shown by way of example, of the cleaning plate when two motors are synchronized and are rotating in the same directions.

In FIG. 20, top views of four different positions are shown of the cleaning plate 5 using the FIG. 3 and FIG. 4 machine 1. The four different positions are designated 96-1, 96-2, 96-3 and 96-4. In FIG. 20, the motors 22-1 and 22-1 are rotating in the same direction and remain aligned. In the embodiments with the same direction rotation of the motors 22-1 and 22-2, the cleaning action is particularly suitable for soft surfaces such as rugs with deep piles and loops. A 4 millimeter offset has been found suitable for a machine having a minimum treatment dimension, M_D, of 7 inches (see FIG. 1). For hard surfaces such as wood floors and rugs with short piles and loops, a 2 millimeter oscillation has been found suitable for a machine having a minimum treatment dimension, M_D, of 6.5 inches. In general, an oscillation in a range from approximately 2 millimeters to 4 millimeters works well. However, the range of oscillations can be larger for machines having different treatment dimensions.

As shown in FIG. 20, both of the off-set weights 23-1 and 23-2 at one instance in time are oriented as shown in view 96-1 parallel to the X-axis direction at an angle of 180°. The X-axis direction is normal (at right angles) to the Y-axis direction, that is, normal to the direction of travel.

In FIG. 20, the off-set weights 23-1 and 23-2 at another instance of time are oriented as shown in view 96-2 with the weight 23-1 at 270° with respect to the X-axis and with the weight 23-2 at 270° with respect to the X-axis.

In FIG. 20, the off-set weights 23-1 and 23-2 at another instance of time are oriented as shown in view 96-3 with the weight 23-1 at 0° with respect to the X-axis and with the weight 23-2 at 0° with respect to the X-axis.

In FIG. 20, the off-set weights 23-1 and 23-2 at another instance of time are oriented as shown in view 96-4 with the weight 23-1 at 90° with respect to the X-axis and with the weight 23-2 at 90° with respect to the X-axis.

When the rotors of the motors are rotating, then the off-set weights 23-1 and 23-2 become oriented, at different instances of time, at all the angles from 0° to 360° where the views 96-1, 96-2, 96-3 and 96-4 are examples. The off-set weights 23-1 and 23-2 in FIG. 20 are synchronized in that the angular orientation over many rotations of the off-set weights 23-1 and 23-2 through 360° remains the same. Further, off-set weights 23-1 and 23-2 in FIG. 20 are synchronized and phased to be substantially at the same angle in the X-axis direction, that is, synchronized and phased to be substantially at the same angle in the direction normal to the direction of travel. Specifically, in the orientation of view 96-1, the off-set weights 23-1 and 23-2 are both at an angle of 180° with respect to the X-axis. Specifically, in the orientation of view 96-3, the off-set weights 23-1 and 23-2 are both at an angle of 0° with respect to the X-axis. While the examples of the orientations of view 96-1 and 96-3 have equal phase angles, that is, 180° and 0°, very good performance is achieved when the phase angles are approximately within +/−10° of each other. For example, the off-set weight 23-1 might be at 20° when the off-set weight 23-1 is at 0°.

Figure 21:
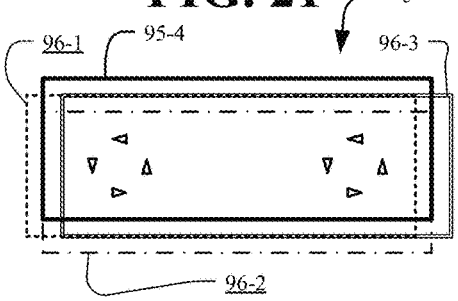
FIG. 21 depicts a top view of the four different positions of the cleaning plate when the two motors are rotating in the same direction as shown in FIG. 20.

In FIG. 21 a non-shifted top view of the four different positions of FIG. 20 are shown for the cleaning plate using the FIG. 3 and FIG. 4 machine 1. The four different positions are designated 96-1, 96-2, 96-3 and 96-4.

Figure 22:
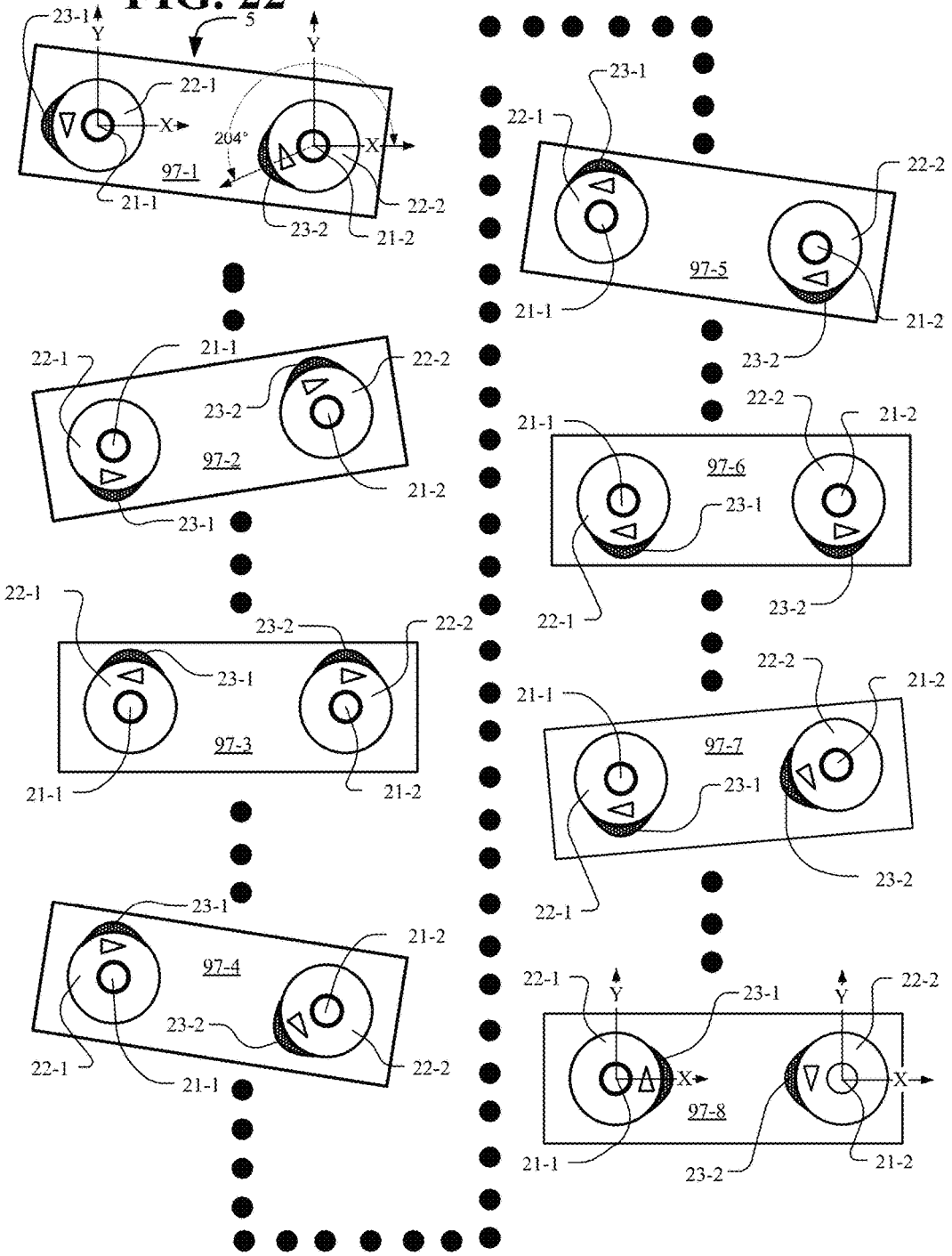
FIG. 22 depicts eight different positions, shown by way of example, of the cleaning plate when two motors are unsynchronized and are rotating in opposite directions.

In FIG. 22, shifted top views of eight different positions are shown of the cleaning plate 5 according to the FIG. 3 and FIG. 4 machine 1. The eight different positions are designated 97-1, 97-2, . . . , 97-8 and are representative of the many different positions of the cleaning plate 5 of machine 1 when the motors 22-1 and 22-2 are not synchronized. In FIG. 22, the motors 22-1 and 22-1 are rotating in opposite directions. With the motors of FIG. 22, the drive shafts 21-1 and 21-2 do not remain aligned and are unsynchronized. In embodiments such as FIG. 22 with the counter rotation of the motors 22-1 and 22-2, the cleaning action is suitable for hard surfaces such as wood floors and rugs with short piles and loops. A 2 millimeter oscillation has been found suitable for a machine having a minimum treatment dimension, M_D, of 6.5 inches (see FIG. 1). When the drivers 22-1 and 22-1 are unsynchronized, the machine 1 at times tends to pull in one direction or another in the XY-plane. The least desirable phase orientation of the off-set weights 23-1 and 23-2 is as shown in view 97-8 where off-set weight 23-1 is at 0° and off-set weight 23-2 is at 180°. The synchronized operations as described in connection with FIG. 18 through FIG. 21 avoid the 180° out-of-phase condition of view 97-8 in FIG. 22 and avoids other out-of-phase conditions less severe than the 180° out-of-phase condition of view 97-8.

Figure 23:
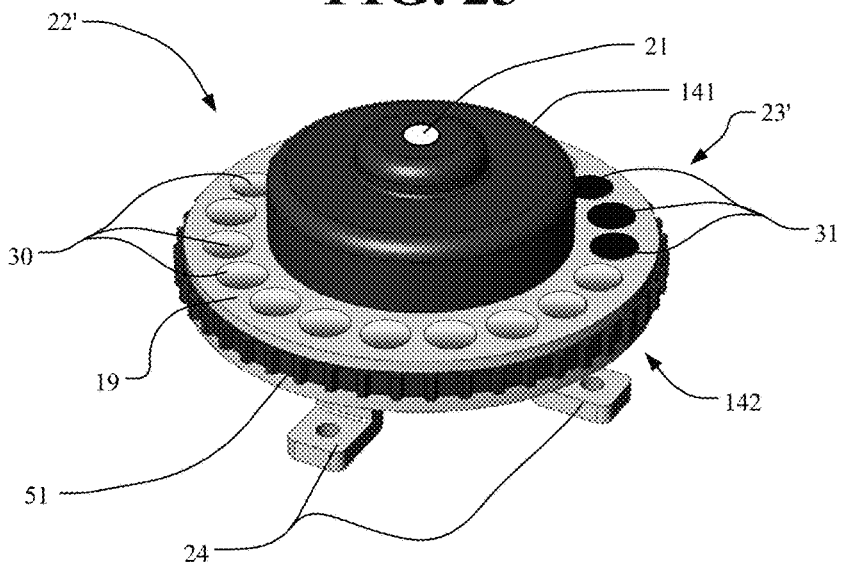
FIG. 23 depicts a perspective view of a typical motor having an asymmetrical weight.

In FIG. 23, a perspective view is shown of a typical motor 22' having an asymmetrical offset weight 23'. The motor 22 includes a rotor 141 that rotates about a central shaft 21 and about the stator 142 (not explicitly shown). The stator 142 includes legs 24 for mounting the motor and specifically the stator. The rotor 141 has the offset weight 23' attached so that when the rotor turns, the offset weight 23' turns causing a vibration and hence an oscillation of anything attached to the legs 24. In the embodiment described, a ring 19 is attached to the rotor 141. The ring 19 includes holes 30 entirely around the rotor 141. Most of the holes 30 are empty and a number of holes 31 are filled with heavy material such as metal to form the offset weight 23'. The ring 19 includes a gear 51 which in one embodiment is a fiber belt and in other embodiments has metal teeth.

Figure 24:
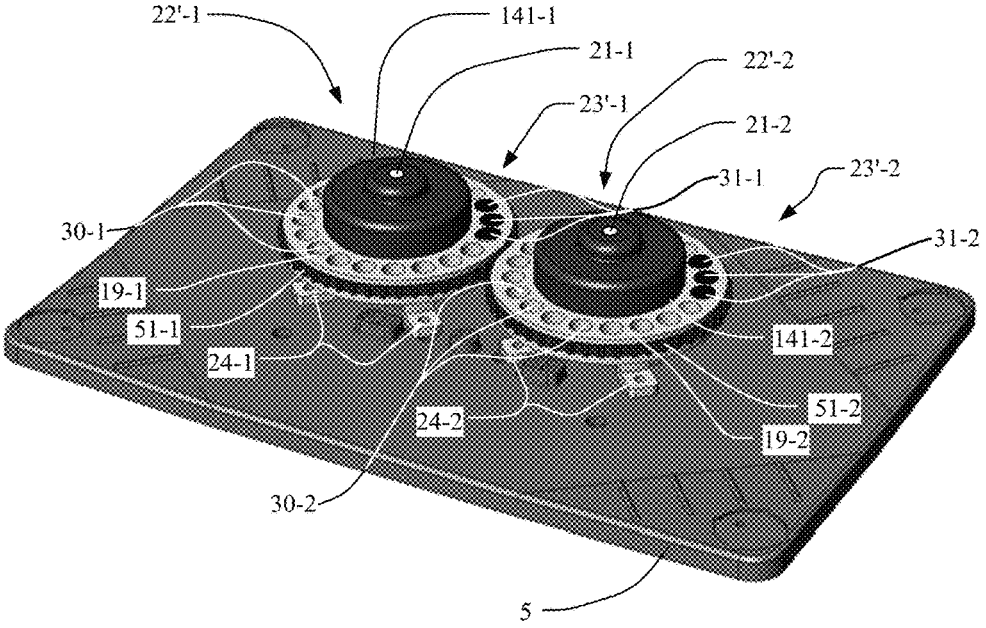
FIG. 24 depicts a perspective view of a pair of motors, each having an asymmetrical weight, and having the motors synchronized.

In FIG. 24, a perspective view of two motors 22'-1 and 22'-2, each having an asymmetrical weight 23'-1 and 23'-2, respectively, are shown where the motors are synchronized. The motor 22'-1 includes a rotor 141-1 that rotates about a central shaft 21-1 attached to the legs 24-1. The legs 24-1 are rigidly attached to the cleaning plate 5. The rotor 141-1 has the offset weight 23'-1 attached so that when the rotor turns, the offset weight 23'-1 turns causing a vibration and hence an oscillation of the cleaning plate 5 attached to the legs 24-1. In the embodiment described, a ring 19-1 is attached to the rotor 141-1. The ring 19-1 includes holes 30-1 entirely around the rotor 141-1. Most of the holes 30-1 are empty and a number of holes 31-1 are filled with heavy material such as metal to form the offset weight 23'-1. The ring 19-1 includes a gear 51-1. The motor 22'-2 includes a rotor 141-2 that rotates about a central shaft 21-2 attached to the legs 24-2. The legs 24-2 are rigidly attached to the cleaning plate 5. The rotor 141-2 has the offset weight 23'-2 attached so that when the rotor turns, the offset weight 23'-2 turns causing a vibration and hence an oscillation of the cleaning plate 5 attached to the legs 24-2. In the embodiment described, a ring 19-2 is attached to the rotor 141-2. The ring 19-2 includes holes 30-2 entirely around the rotor 141-2. Most of the holes 30-2 are empty and a number of holes 31-2 are filled with heavy material such as metal to form the offset weight 23'-2. The ring 19-2 includes a gear 51-2. The motors 22'-1 and 22'-2 are positioned such that the gear 51-1 has teeth that engage the teeth of the gear 51-2 whereby the rotation of the rotors 141-1 and 141-2 are synchronized. With such synchronization, the motors 22'-1 and 22'-2 rotate in the opposite direction and the oscillation operation is as described in connection with FIG. 18 and FIG. 19.

Figure 25:
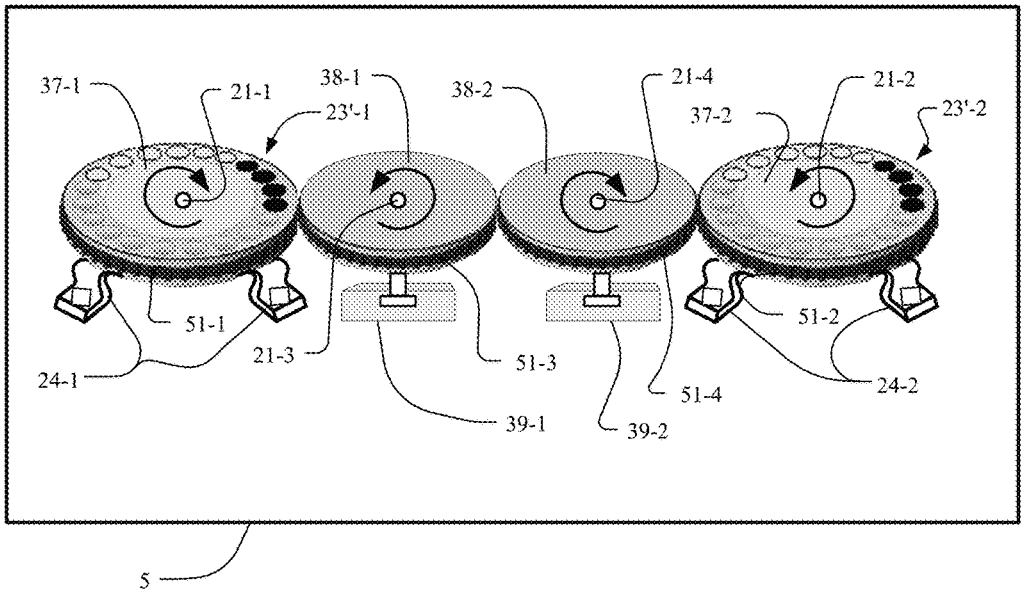
FIG. 25 depicts a perspective view of a pair of driving gears, each having an asymmetrical weight, and having the driving gears synchronized by a pair of synchronizing gears.

In FIG. 25, a perspective view of a pair of driving gears 37-1 and 37-2, is shown. The driving gears 37-1 and 37-2 have asymmetrical offset weights 23'-1 and 23'-2, respectively. The driving gears 37-1 and 37-2 rotate around spindles 21-1 and 21-2, respectively. The spindles 21-1 and 21-2 attach to a stator (not shown) and attach to the feet 24-1 and 24-2, respectively, which attach to the cleaning plate 5 by bolts, welding or other securing means. The driving gears 37-1 and 37-2 are driven by synchronizing gears 38-1 and 38-2, respectively. The synchronizing gears 38-1 and 38-2 attach through bushings 39-1 and 39-2, respectively, to the cleaning plate 5. When the synchronizing gear 38-2 is turning clockwise, the driving gear 37-2 and the synchronizing gear 21-3 turn counterclockwise. When the synchronizing gear 21-3 is turning counterclockwise, the driving gear 37-1 is turning clockwise, opposite the counterclockwise direction of the driving gear 37-2.

Figure 26:
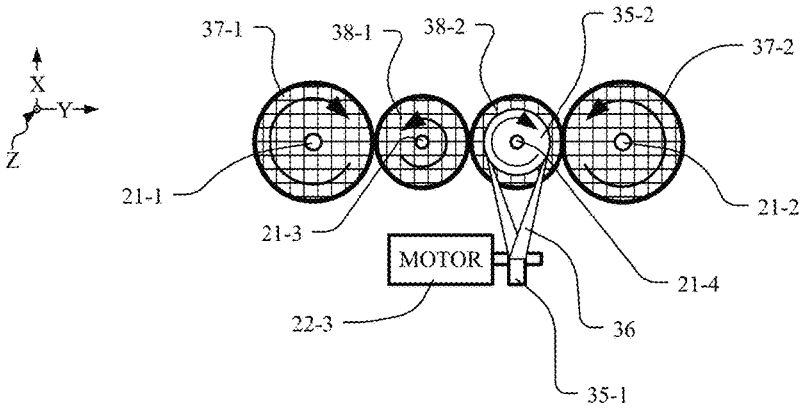
FIG. 26 depicts a schematic top view of the gears of FIG. 25 and having a motor, pulleys and a belt for driving the gears.

In FIG. 26, a schematic top view of the gears 37-1, 37-2, gears 38-1 and 38-2 of FIG. 25 are shown with a motor 22-3, pulleys 35-1 and 35-2 and a belt 36 for driving the gears. In the embodiment of FIG. 25 and FIG. 26, a single motor 22-3 drives two separate offset drivers, 37-1 and 37-2, in opposite directions and in synchronism.

Figure 27:
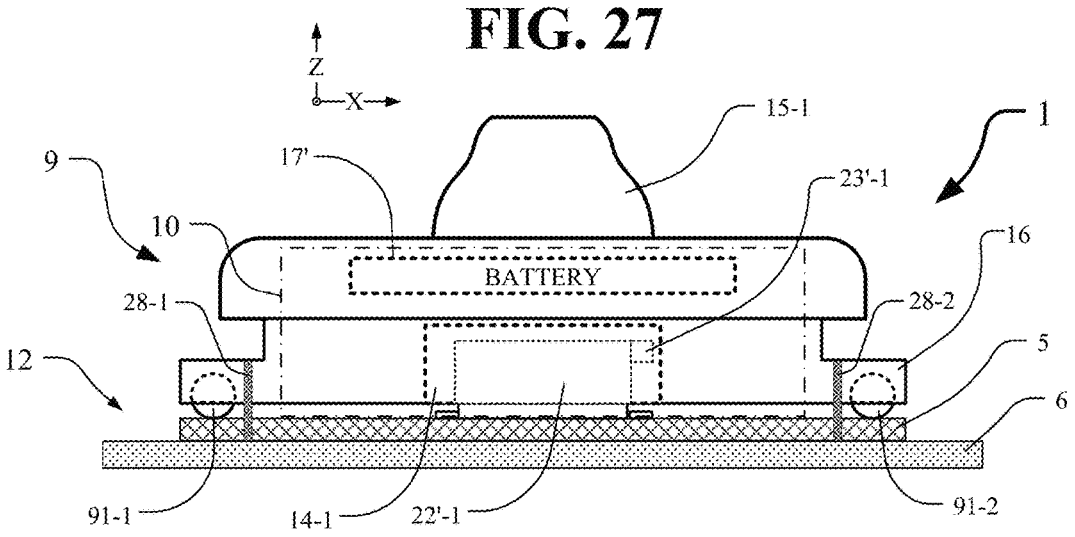
FIG. 27 depicts a schematic front view with further details of one embodiment of a single motor and the cleaning plate assembly suitable for of the machine of FIG. 1 and FIG. 2.

In FIG. 27, a schematic front view with further details of one embodiment of a drive assembly 10 having a single motor 22'-1 and the cleaning plate 5 are shown and are suitable for the machine 1 of FIG. 1 and FIG. 2. The drive assembly 10 includes motor 22'-1 directly connected to the cleaning plate 5. The motor 22'-1 includes off-set weight 23'-1. The off-set weight 23'-1 causes the cleaning plate 5 and the attached cleaning pad 6 to oscillate in the XY-plane, that is, in the plane parallel to the floor. The body plate 16 is separated from the cleaning plate 5 by ball bearings 91-1 and 91-2. The compression devices 28-1 and 28-2 urge the body plate 16 and the cleaning plate 5 toward each other while the ball bearings 91-1 and 91-2 hold the body plate 16 and the cleaning plate 5 apart. The ball bearings 91-1 and 91-2 allow the body plate 16 and the cleaning plate 5 to slide parallel to each other in the XY-plane thereby allowing the cleaning plate to oscillate in the XY-plane. The compression devices 28-1 and 28-2 can be any equivalent compression devices such as those described in connection with FIG. 11 through FIG. 17.

In FIG. 27, the motor 22'-1 is connected to the cleaning plate 5 and is not connected to the body plate 16 or any other part of the body 9. The body 9 includes an opening 14-1 into which the motor 22'-1 extends without contacting the body 9. A battery unit 17' provides battery power to drive the motor 22'-1.

Figure 28:
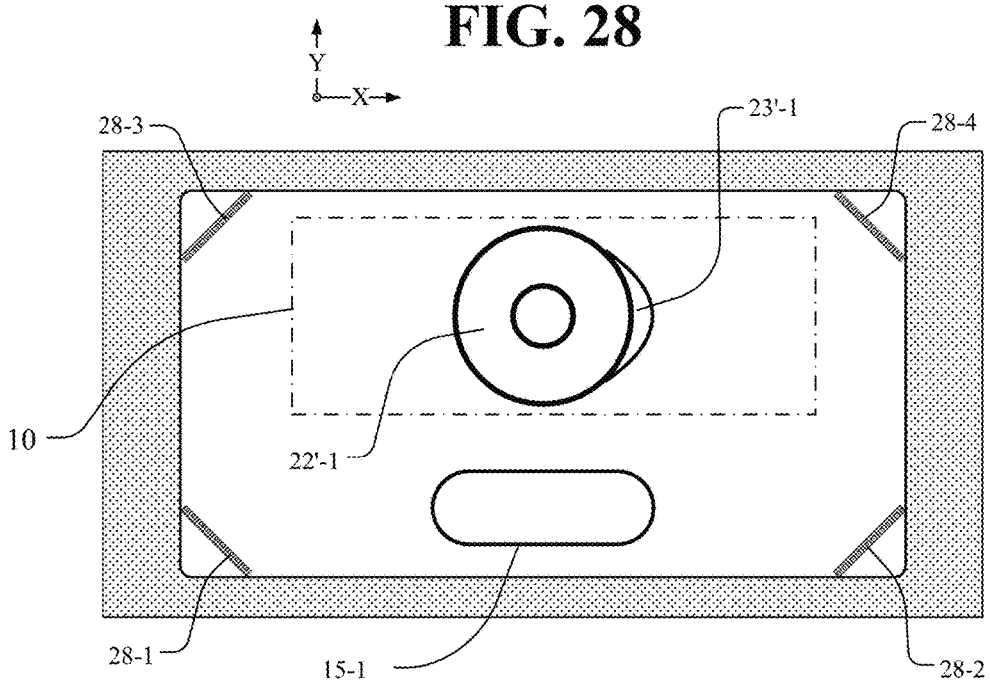
FIG. 28 depicts a schematic top view of the apparatus of FIG. 27.

In FIG. 28, a schematic top view of the machine 1 of FIG. 27 is shown. The drive assembly 10 includes motor 22'-1 directly connected to the cleaning plate 5. The motor 22-1 includes off-set weight 23'-1. The off-set weight 23-1 causes the attached cleaning pad 6 to oscillate in the XY-plane, that is, in the plane parallel to the floor by operation of the cleaning plate 5 (as described in connection with FIG. 3). The compression devices 28-1, 28-2, 28-3 and 28-4 urge the body plate 16 toward the cleaning plate 5 (as shown in FIG. 3 for compression devices 28-1 and 28-2). The handle connector 15-1 is provided for connecting a handle to the body 9.

Figure 29:
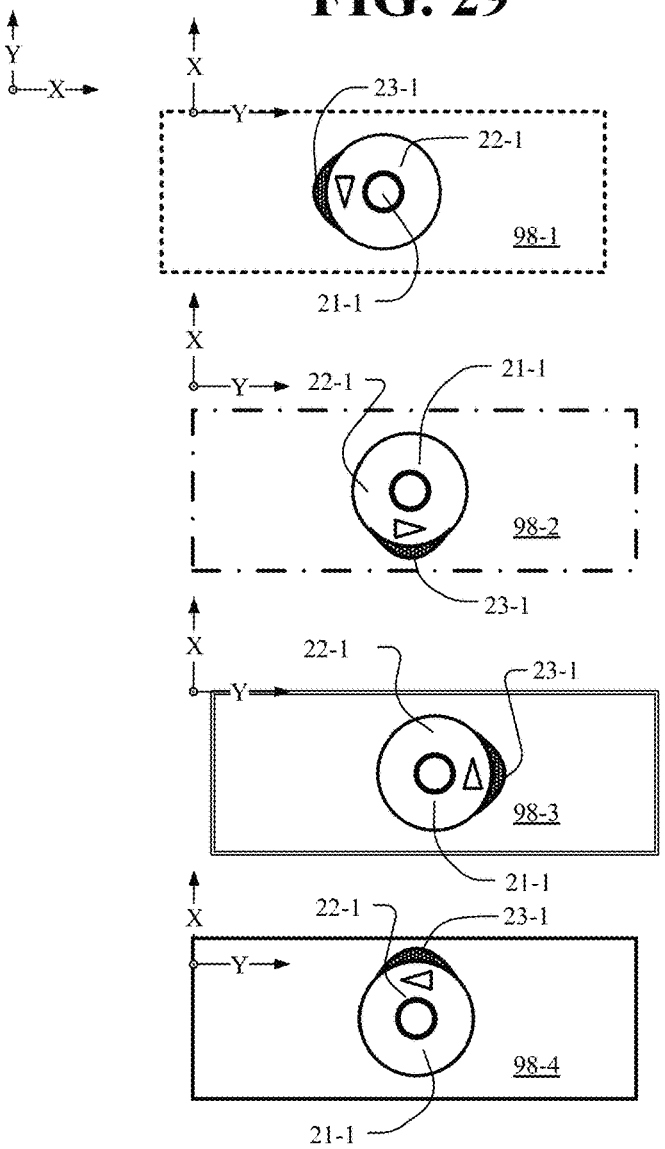
FIG. 29 depicts four different positions, shown by way of example, of the cleaning plate when a single motor drives the cleaning plate.

FIG. 29 depicts four different positions, shown by way of example, of the cleaning plate 5 when a single motor 22-1 of FIG. 27 and FIG. 28 drives the cleaning plate 5. The four different positions are designated 98-1, 98-2, 98-3 and 98-4.

Figure 30:
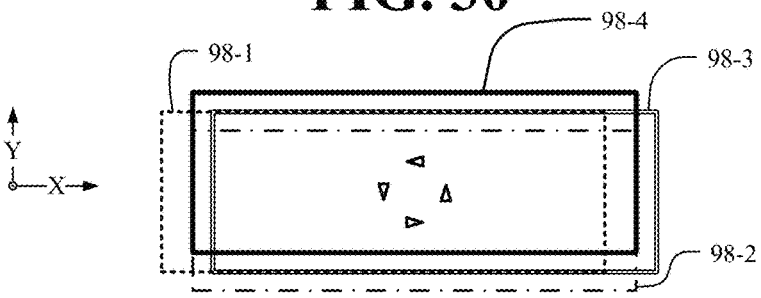
FIG. 30 depicts a top view of the cleaning plate in the four different positions of FIG. 29.

In FIG. 30, a top view of the four different positions of FIG. 29 are shown. The four different positions are designated 98-1, 98-2, 98-3 and 98-4.

Figure 31:
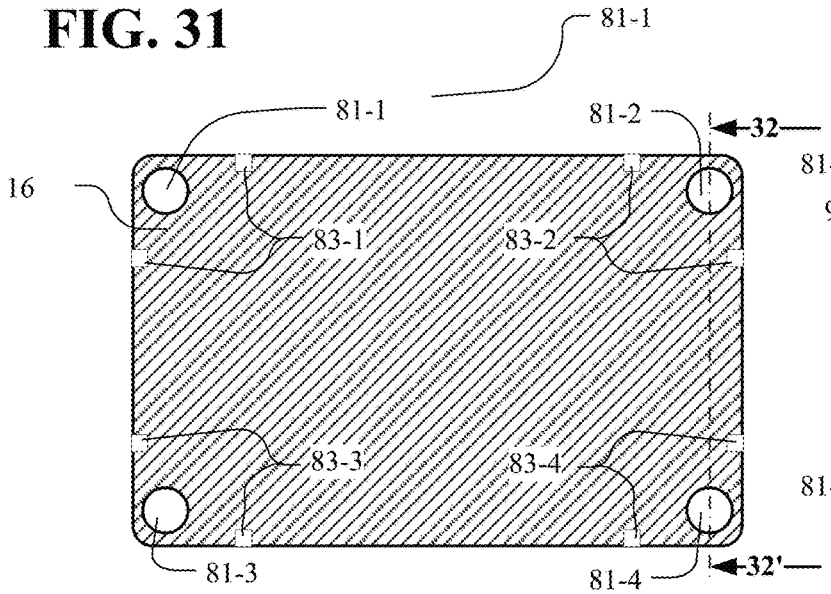
FIG. 31 depicts a bottom view of a body plate.

In FIG. 31, a bottom view of the body plate 16 of FIG. 3 is shown. The body plate 16 has pockets 81, including pockets 81-1, 81-2, 81-3 and 81-4, for receiving ball bearings. The body plate 16 has notches 83-1, 83-2, 83-3 and 83-4, for receiving the compression O-rings 28-1, 28-2, 28-3 and 28-4 of FIG. 4.

Figure 32:
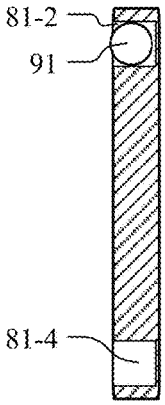
FIG. 32 depicts an end view of the body plate of FIG. 31.

In FIG. 32, an end view of the body plate 16 of FIG. 31 is shown taken along section line 32-32' of FIG. 31. The body plate 16 includes the deep recesses 81-2 and 81-4 for holding ball bearings, like ball bearing 91 shown as typical, in recess 81-2.

Figure 33:
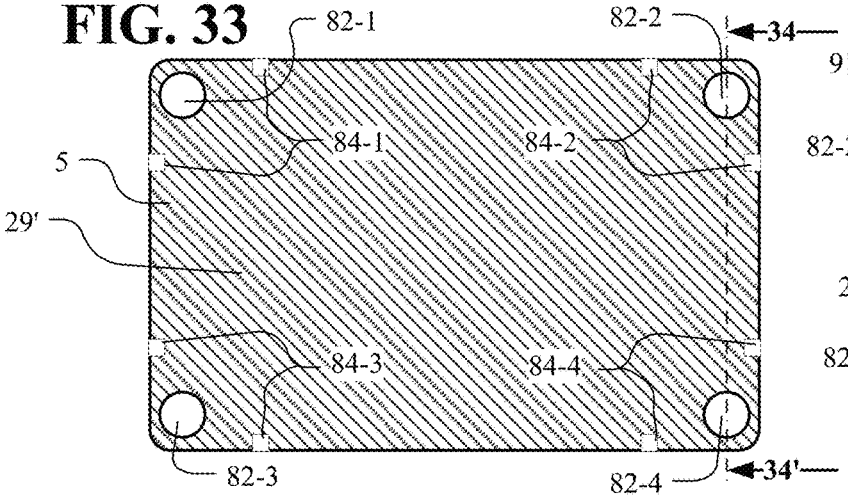
FIG. 33 depicts a top view of a cleaning plate.

In FIG. 33, a top view of the cleaning plate 5 of FIG. 31 is shown. The cleaning plate 5 has pockets 82, including pockets 82-1, 82-2, 82-3 and 82-4, for receiving ball bearings which are in the pockets 81-1, 81-2, 81-3 and 81-4, respectively, of body plate 16 in FIG. 31. The cleaning plate 16 has notches 84-1, 84-2, 84-3 and 84-4 for receiving the compression O-rings 28-1, 28-2, 28-3 and 28-4 of FIG. 4.

Figure 34:
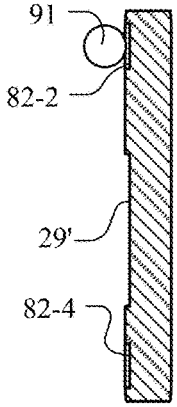
FIG. 34 depicts an end view of the cleaning of FIG. 33.

In FIG. 34, an end view of the cleaning plate 5 of FIG. 33 is shown taken along section line 34-34' of FIG. 33. The cleaning plate 5 includes the shallow recesses 82-2 and 82-4 for engaging ball bearings like ball bearing 91 in FIG. 32. The shallow recesses 82-2 and 82-4 are juxtaposed the deep recesses 81-2 and 81-4 when the body plate 16 is juxtaposed the cleaning plate 5. The ball bearings, like ball bearing 91, are seated in the deep recesses 81-2 and 81-4 and contact the shallow recesses 82-2 and 82-4. The diameters of the ball bearings are greater than the combined depths of the shallow recesses 82-2 and 82-4 and the deep recesses 81-2 and 81-4 so that the ball bearings hold the body plate 16 apart from the cleaning plate 5.

Figure 35:
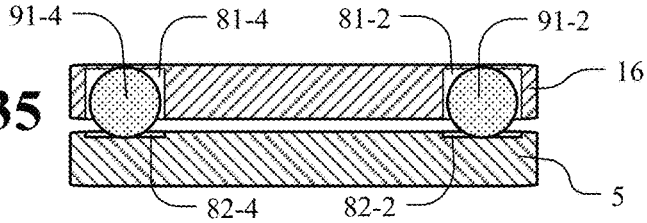
FIG. 35 depicts an end view of the body plate of FIG. 32 juxtaposed the cleaning plate of FIG. 34 and held offset by ball bearings.

In FIG. 35, the fixed body plate 16 is adjacent the cleaning plate 5 and is held offset from the cleaning plate 5 by rolling bearings, particularly ball bearings 91-2 and 91-4, shown as typical. The ball bearing 91-2 rolls in recess 81-2 in body plate 16 and in recess 82-2 in cleaning plate 5. The ball bearing 91-4 rolls in recess 81-4 in body plate 16 and in recess 82-4 in cleaning plate 5.

Figure 36:
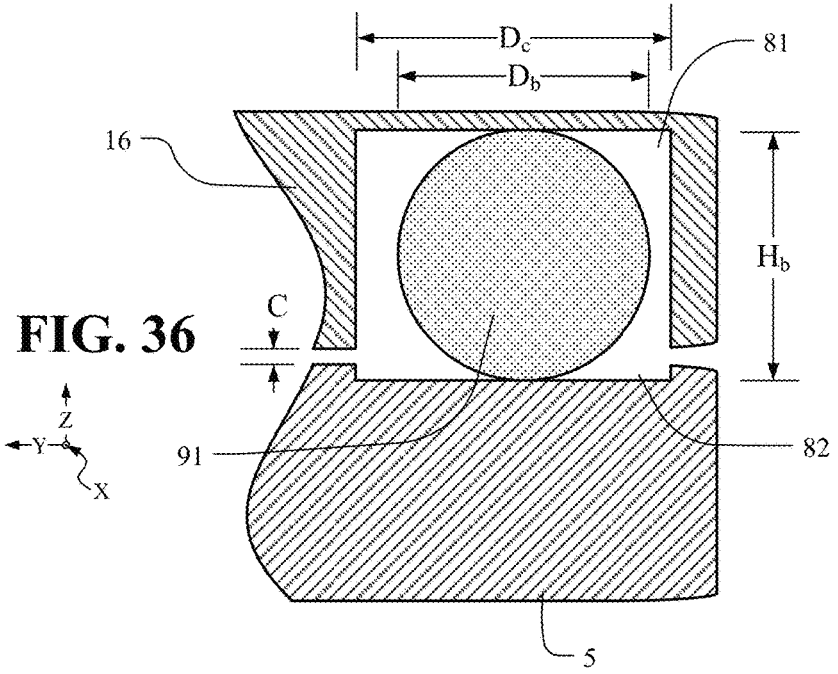
FIG. 36 depicts an expanded view of a portion of FIG. 35 with the body plate adjacent the cleaning plate and held offset from the cleaning plate by one rolling ball bearing.

In FIG. 36, an expanded view is shown of a portion of FIG. 35 with the fixed body plate 16 adjacent the cleaning plate 5 and held offset from the cleaning plate 5 by one rolling bearing, ball bearing 91. Ball bearing 91 is typical of ball bearings 91-2 and 91-4. Ball bearing 91 has a diameter, $D_b$, large enough to maintain a gap of dimension C to separate body plate 16 and the cleaning plate 5. The diameter, $D_b$, equals a height, $H_b$, which is sufficient to maintain the gap C when the ball bearing is within the pockets 81 and 82. The diameter, $D_C$, of the pockets 81 and 82 is substantially greater than the diameter, $D_b$, to enable the cleaning plate 5 to oscillate in the XY plane relative to the fixed body plate 16.

Figure 37:
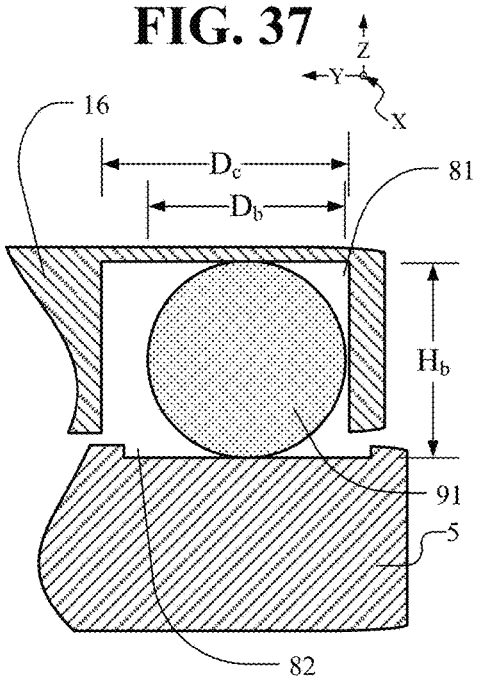
FIG. 37 depicts the view of FIG. 36 with the body plate adjacent the cleaning plate and held offset from the cleaning plate by one rolling bearing rolled in one direction.

In FIG. 37, the expanded view of FIG. 36 is shown with the fixed body plate 16 adjacent the cleaning plate 5 and held offset from the cleaning plate 5 by ball bearing 91. The cleaning plate 5 has moved the maximum amount in one direction along the Y-axis. The ball bearing 91 has sufficient room in the pockets 81 and 82 to allow the movement of the cleaning plate 5 since the diameter of the cavity, $D_C$, is large enough to permit such movement.

Figure 38:
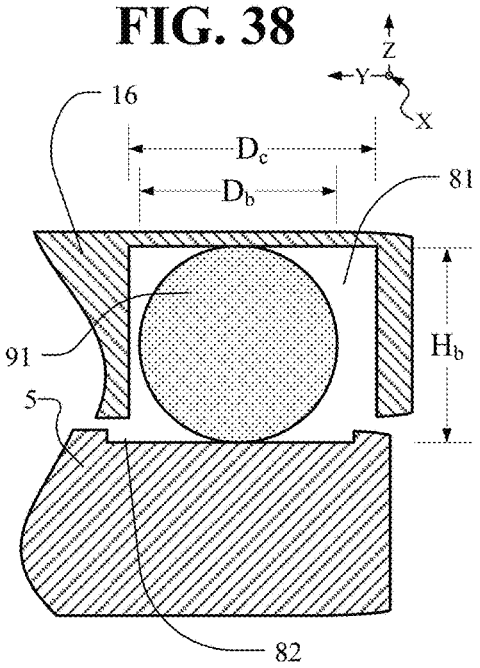
FIG. 38 depicts the expanded view of FIG. 36 with the body plate adjacent the cleaning plate and held offset from the cleaning plate by one rolling bearing rolled in a direction opposite of the direction of FIG. 37.

In FIG. 38, the expanded view of FIG. 36 is shown with the fixed body plate 16 adjacent the cleaning plate 5 and held offset from the cleaning plate 5 by ball bearing 91. The cleaning plate 5 has moved the maximum amount in a direction along the Y-axis opposite the movement direction in FIG. 37. The ball bearing 91 has sufficient room in the pockets 81 and 82 to allow the movement of the cleaning plate 5 since the diameter of the cavity, $D_C$, is large enough to permit such movement.

Figure 39:
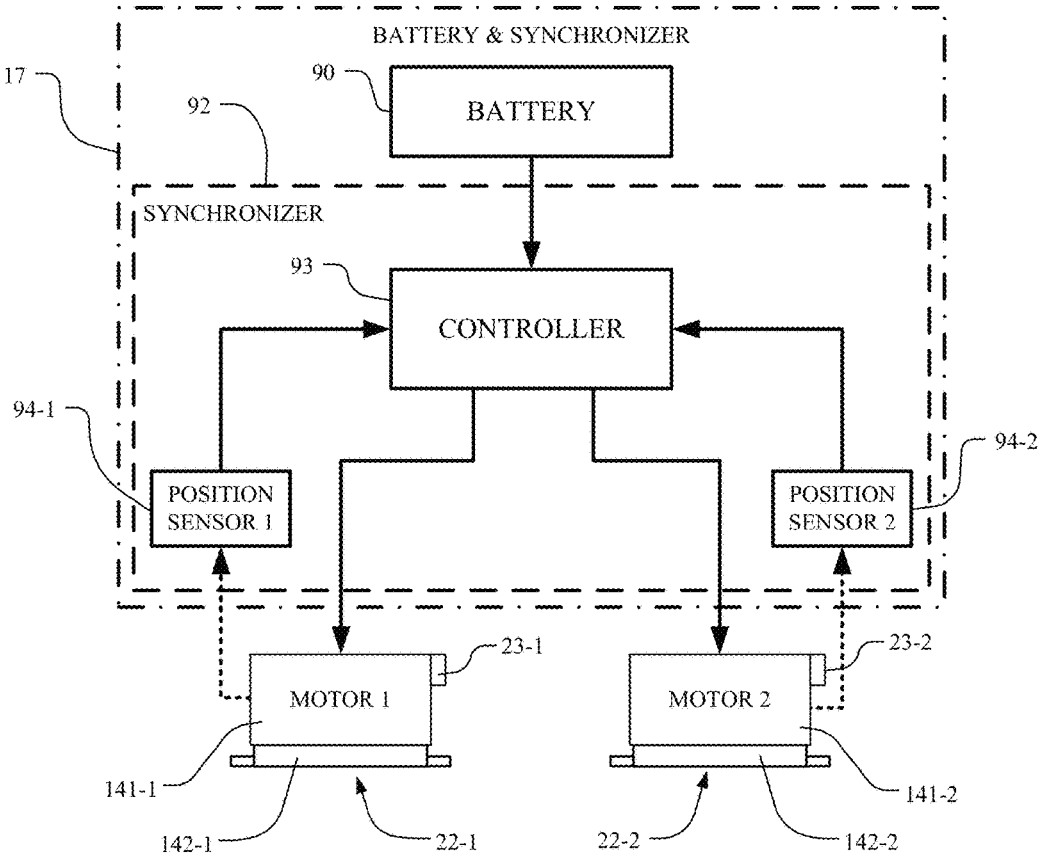
FIG. 39 depicts a battery and synchronizer unit for driving a first and second motor.

In FIG. 39, a battery and synchronizer unit 17 is shown for driving a first motor 22-1 and a second motor 22-2. A first position sensor 94-1 senses the position of the rotor 141-1 of the first motor 22-1 and a second position sensor 94-2 senses the position of the rotor 141-2 of the second motor 22-1. The first position sensor 94-1 provides a first position signal to a controller 93 indicating the position of the rotor 141-1 of the first motor 22-1 and the second position sensor 94-2 and provides a second position signal to the controller 93 indicating the position of the rotor 141-2 of the first motor 22-2. The first position signal inherently indicates the position of the first offset weight 23-1 and the second position signal inherently indicates the position of the second offset weight 23-2. The controller 93 analyzes the difference between the first and second position signals and drives the first motor 22-1 and the second motor 22-2 so that the difference approaches zero and therefore the angular positions of the first offset weight 23-1 and the second offset weight 23-2 are the same.

Figure 40:
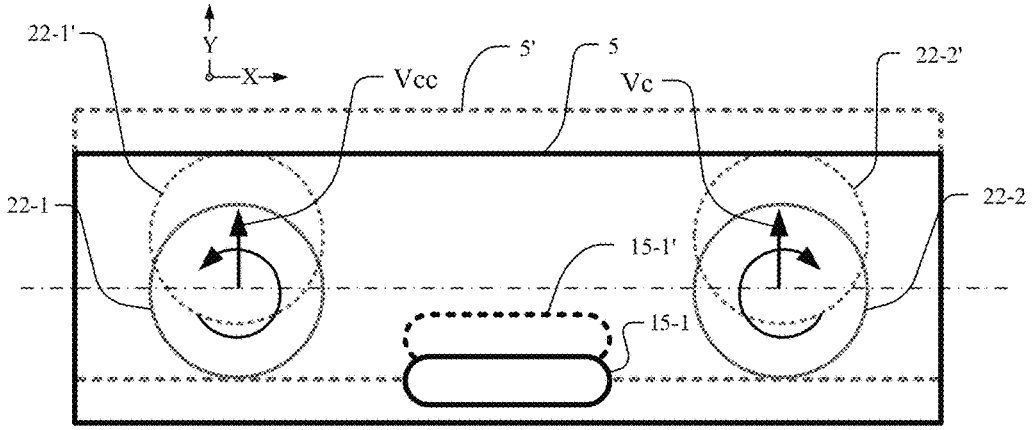
FIG. 40 depicts a schematic top view of a surface treating machine having first and second counter rotating motors.

In FIG. 40, a schematic top view is shown of a portion of a surface treating machine 1. The surface treating machine 1 has first motor 22-1 and second counter rotating motor 22-2. The first motor 22-1 and the second motor 22-2 have stators connected to the cleaning plate 5. The first motor 22-1 has a rotor rotating in the counter clockwise direction and the second motor 22-2 has a rotor rotating in the clockwise direction. The first motor 22-1 and the second motor 22-2 are located forward in the Y-axis direction of the connector 15-1 which is part of a handle assembly 15 (not shown see FIG. 1 and FIG. 2). The rotating first motor 22-1 and the second motor 22-2 have rotational momentum and according are bound by the well-known principal of physics known as conservation of rotational momentum. As a result, the first motor 22-1 tends to develop a force vector Vcc in the Y-axis direction and the second motor 22-2 tends to develop a force vector Vc in the Y-axis direction. As a result of these force vectors, cleaning plate 5 and the attached first motor 22-1 and the second motor 22-2 tend to be driven in the Y-axis direction as shown by the translated broken line cleaning plate 5' and the attached first motor 22-1' and the second motor 22-2'. The driving force resulting from the force vectors has been found to be beneficial and contributing significantly to the ease of operation when advancing the surface treating machine over a surface being cleaned or otherwise treated.

Figure 41:
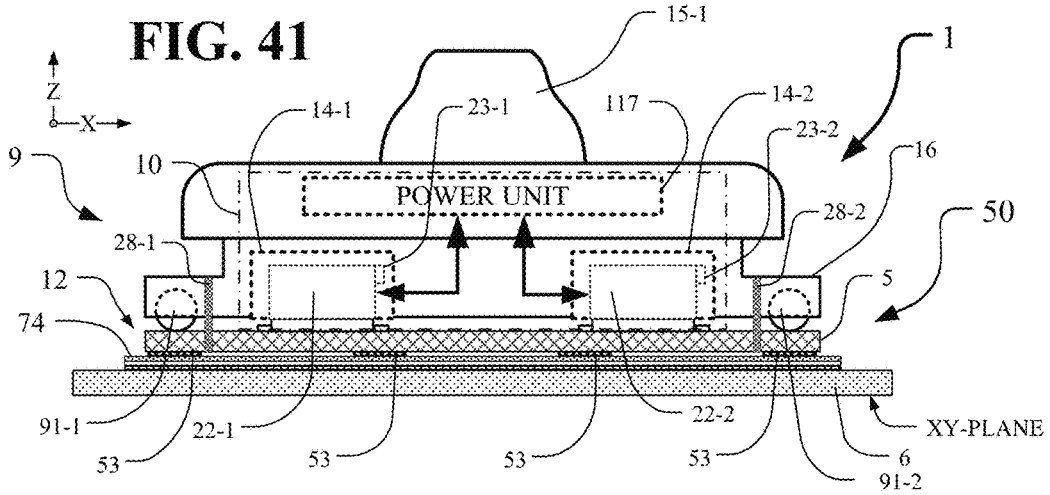
FIG. 41 depicts a schematic front view with further details of another embodiment of the motors in the drive assembly and the cleaning plate assembly of the machine of FIG. 1 and FIG. 2.

In FIG. 41, a front view with further details of one embodiment of the drive assembly 10, the body plate 16 and the cleaning plate assembly 12 of FIG. 1 is shown. The drive assembly 10 includes motors 22-1 and 22-2 directly connected to the cleaning plate 5. The motors 22-1 and 22-2 include off-set weights 23-1 and 23-2, respectively. The off-set weights 23-1 and 23-2 cause the cleaning plate 5 and the attached cleaning pad 6 to oscillate in the XY-plane, that is, in the plane parallel to the floor. The cleaning pad 6 is attached to the cleaning plate 5 by a connection device 74. In one embodiment, the connection device includes on one side a loop surface for attaching to the hook elements 53 that are rigidly attached to the cleaning plate 5. The body plate 16 is separated from the cleaning plate 5 by ball bearings 91-1 and 91-2. The compression devices 28-1 and 28-2 urge the body plate 16 and the cleaning plate 5 toward each other while the ball bearings 91-1 and 91-2 hold the body plate 16 and the cleaning plate 5 apart. The ball bearings 91-1 and 91-2 allow the body plate 16 and the cleaning plate 5 to slide parallel to each other and parallel to the XY-plane thereby allowing the cleaning plate to oscillate parallel to the XY-plane.

The motors 22-1 and 22-2 are connected to the cleaning plate 5 and are not connected to the body plate 16 or any other part of the body 9. The body 9 includes openings 14-1 and 14-2 into which the motors 22-1 and 22-2 extend without contacting the body 9. The motors 22-1 and 22-2 preferably have a small dimension in the Z-axis direction normal to the XY-plane to help lower the center of gravity of the machine 1 toward the XY-plane.

In FIG. 41, a power unit 117 provides power to drive the motors 22-1 and 22-2. When the power unit 117 includes a battery and a synchronizer, the weights 23-1 and 23-2 are maintained in predetermined rotational directions by operation of the electrical signals to and from the motors 22-1 and 22-2. In operation, the first offset weight 23-1 and the second offset weight 23-2 are maintained at synchronized rotational angles. Synchronized rotational angles are angles that are repeatedly the same for each revolution of the motors. For example, when the first offset weight 23-1 is at 90° and the second offset weight 23-2 is also at 90° for each revolution, then the first offset weight 23-1 and the second offset weight 23-2 are at synchronized rotational angles. The synchronized rotational angles can be any values. By way of further example, the first offset weight 23-1 can be at 0° and the second offset weight 23-2 can be at 180° for each revolution. When the rotational angles differ during different revolutions, the first offset weight 23-1 and the second offset weight 23-2 are maintained at unsynchronized rotational angles. For example, when the first offset weight 23-1 is at 90° and the second offset weight 23-2 is also at 90° for one revolution and the first offset weight 23-1 is at 90° and the second offset weight 23-2 is 75° for another revolution, the first offset weight 23-1 and the second offset weight 23-2 are at unsynchronized rotational angles.

When the power unit 117 includes a battery and does not include a synchronizer, the weights 23-1 and 23-2 are not maintained in predetermined rotational directions but tend to be at random rotational directions that change during operation so that unsynchronized operation is obtained. The unsynchronized operation causes the offset weights to be at synchronized rotational angles and at unsynchronized rotational angles at different times.

In FIG. 41, the attachment assembly 50 includes a plurality of compression devices, like compression devices 28-1 and 28-2, connected between the cleaning plate 5 and the body plate 16 for urging the cleaning plate 5 and the body plate 16 toward each other. The compression devices like devices 28-1 and 28-2 are, for example, O-rings, springs, elastic bands or cushioned shaft connectors. The compression devices 28-1 and 28-2 in the embodiment of FIG. 41 are 0-rings. The attachment assembly 50 includes a plurality of rolling separators, such as ball bearings 91-1 and 91-2, under pressure from the compression devices 28-1 and 28-2 for separating the cleaning plate 5 and the body plate 16.

Figure 42:
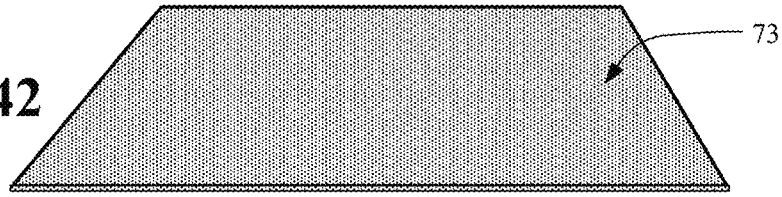
FIG. 42 depicts a loop layer that is one of the layers that forms part of a loop and hook attachment assembly.
Figure 43:
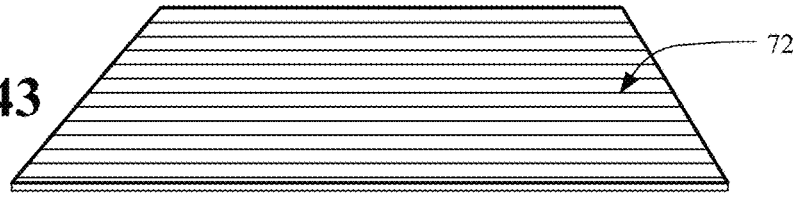
FIG. 43 depicts a plastic layer that is another one of the layers that forms part of a loop and hook attachment assembly.
Figure 44:
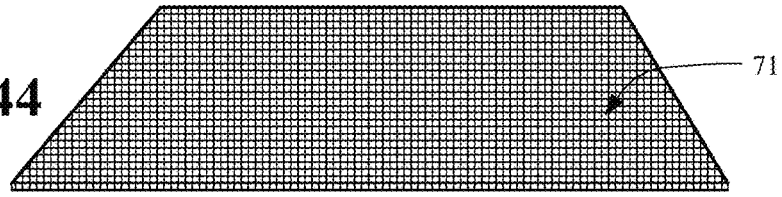
FIG. 44 depicts a hook layer that is another one of the layers that forms part of a loop and hook attachment assembly.

In FIG. 42, FIG. 43 and FIG. 44, three layers of one embodiment of a connection device 74 are shown. The three layers form a loop and hook embodiment of the connection device 74.

In FIG. 42, a loop layer 73 is one of the layers that forms part of a loop and hook assembly. The loops of the loop layer 73 form a good loop and hook fastening to hooks 53 the hook elements 53 that are rigidly attached to the cleaning plate 5 of FIG. 41.

In FIG. 43, a plastic layer 72 is another one of the layers that forms part of the connection device 74.

In FIG. 44, a hook layer 71 is another one of the layers that forms part of the connection device 74.

Figure 45:
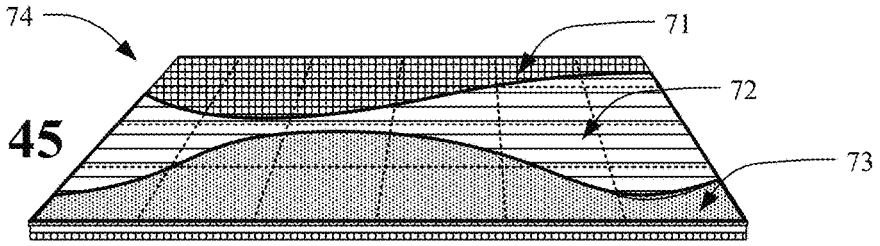
FIG. 45 depicts a cut away view of a loop and hook embodiment of an attachment assembly that is formed by the combination of the FIG. 42, FIG. 43 and FIG. 44 layers.

In FIG. 45, a cut away view of a loop and hook embodiment of the connection device 74 is formed by the combination of the FIG. 42, FIG. 43 and FIG. 44 layers. The layers 71, 72 and 73 are adhered together to form the loop and hook embodiment of the connection device 74 as a unitary piece. In one embodiment, the layers 71, 72 and 73 are sewn together to form the unitary attachment structure 74. The loop layer 73 is designed to fasten to the hooks 53 of the cleaning plate 12 (see FIG. 41). The loop and hook fastening with hooks 53 and loops of layer 73 use "small hooks" of about 0.04 inch. Similarly, the hook layer 71 provides "small hooks" of about 0.04 inch. As an alternative, the hook layer 71 provides "large hooks" that range from 0.08 inch to 0.25 inch. In one embodiment, the hooks are 0.10 inch. With the selection of small hooks and large hooks, for layers 73 and 71, respectfully, the loop and hook connection device 74 functions as a hook size converter. The small hooks are useful for loop and hook fastening to the cleaning plate 12. The large hooks are useful for loop and hook fastening to cleaning heads, such as floor pad heads. In addition to the function of being a hook size converter, the loop and hook assembly 74 functions as a barrier to prevent dirt and liquids from penetrating to the cleaning plate 12 of FIG. 41. Accordingly, the loop and hook connection device 74 is generally larger than the cleaning plate 12. In one embodiment, the cleaning plate 12 measures 7 inches by 11 inches and the loop and hook connection device 74 measures 8 inches by 12 inches.

Although the loop and hook connection device 74 in one embodiment is formed using three separate layers 71, 72 and 73 other structures can be formed. For example, the hooks in layer 71 can be molded as part of the plastic layer 72 thereby eliminating the need for layer 71. As additional alternatives for the connection device 74, the hooks elements 53 of FIG. 41 and the loop layer 73 of FIG. 42 and FIG. 45 can be removed by allowing the layer 72 of FIG. 43 and FIG. 45 to directly attach to the cleaning plate 5 by clips, latches or other attachment mechanisms.

While the invention has been particularly shown and described with reference to preferred embodiments thereof it will be understood by those skilled in the art that various changes in form and details may be made therein without departing from the scope of the invention.

The invention claimed is:

1. A machine for treating a surface lying in an XY plane comprising, a body having a body plate, a cleaning plate located between the body plate and the XY plane, a drive assembly connected to the cleaning plate and having one or more motors to drive the cleaning plate with a cleaning vibration in an oscillating pattern parallel to the XY plane, where the one or more motors are not connected to the body, an attachment assembly for flexibly attaching the cleaning plate to the body plate under compression to permit the cleaning plate to vibrate relative to the body plate and to isolate the cleaning vibration from the body, the attachment assembly including, a plurality of compression devices connected between the cleaning plate and the body for urging the cleaning plate and the body toward each other, a plurality of rolling separators under pressure from the compression devices for separating the cleaning plate and the body plate.

2. The machine of claim 1 wherein compression devices are selected from the group consisting of O-rings, springs, elastic bands and cushioned shaft connectors.

3. The machine of claim 1 wherein the rolling separators are ball bearings.

4. The machine of claim 1 wherein each compression device compresses a corresponding rolling separator.

5. The machine of claim 1 wherein the compression devices each include a cushioned shaft connector having first and second ends, the first end including a first end cap and a first compression washer for engaging the body plate in compression and the second end including a second end cap and a second compression washer for engaging the cleaning plate in compression whereby under oscillation of the cleaning plate, the first end cap and the first compression washer and the second end cap and the second compression washer apply increasing pressure at extremes of travel of the cleaning plate during cleaning oscillations.

6. The machine of claim 1 wherein the one or more motors each includes, a stator fixed to the cleaning plate, a rotor for rotating on a motor axis about the stator, an offset weight rotated asymmetrically by the rotor around the motor axis whereby the cleaning plate is driven with a vibration in an oscillating pattern parallel to the XY plane.

7. The machine of claim 6 wherein each of the one or more motors is a DC motor.

8. The machine of claim 7 further including a battery for supplying power to each of the one or more motors.

9. The machine of claim 1 wherein in the drive assembly the one or more motors form, a first motor apparatus having, a first stator fixed to the cleaning plate, a first rotor for rotating in a first direction about the first stator and about a first motor axis, a first offset weight attached to the first rotor and rotated by the first rotor around the first motor axis whereby the cleaning plate is driven with a first vibration in a first oscillating pattern parallel to the XY plane, a second motor apparatus having, a second stator fixed to the cleaning plate, a second rotor for rotating in a second direction about the second stator and about a second motor axis, a second offset weight attached to the second rotor and rotated by the second rotor around the second motor axis whereby the cleaning plate is driven with a second vibration in a second oscillating pattern parallel to the XY plane, whereby the cleaning plate has a combined vibration formed by the combination of the first vibration and the second vibration.

10. The machine of claim 9 wherein the first direction is clockwise and the second direction is counterclockwise.

11. The machine of claim 9 wherein the drive assembly includes a synchronizer for synchronizing the rotation of the first rotor and the second rotor whereby the first offset weight and the second offset weight are maintained at synchronized rotational angles.

12. The machine of claim 11 wherein the first rotor and the second rotor have a first phase angle and a second phase angle, respectively, for the first offset weight and for the second offset weight, respectively, measured on an axis normal to a direction of travel of the machine, and wherein the synchronizer operates to maintain the first phase angle and the second phase angle substantially the same.

13. The machine of claim 11 wherein the synchronizer includes mechanical gears.

14. The machine of claim 11 wherein the synchronizer includes an electronic feedback network including, a first sensor for sensing the position of the first rotor with a first position signal, a second sensor for sensing the position of the second rotor with a second position signal, a controller responsive the first position signal and the second position signal to drive the first motor and the second motor whereby the first offset weight and the second offset weight are maintained in synchronism at synchronized rotational angles.

15. The machine of claim 1 wherein the cleaning plate includes a vibrator plate, a towel support plate connected to the vibrator plate, and a cleaning towel attached to the towel support plate.

16. The machine of claim 1 wherein the body includes a handle whereby a user can move the machine over a floor lying in the XY plane.

17. A machine for treating a surface lying in an XY plane comprising, a body having a body plate, a cleaning plate located between the body plate and the XY plane, a drive assembly connected to the cleaning plate to drive the cleaning plate with a cleaning vibration in an oscillating pattern parallel to the XY plane wherein the drive assembly includes, a first motor apparatus having, a first stator fixed to the cleaning plate, a first rotor for rotating in a first direction about the first stator and about a first motor axis, a first offset weight attached to the first rotor and rotated by the first rotor around the first motor axis whereby the cleaning plate is driven with a first vibration in a first oscillating pattern parallel to the XY plane, a second motor apparatus having, a second stator fixed to the cleaning plate, a second rotor for rotating in a second direction about the second stator and about a second motor axis, a second offset weight attached to the second rotor and rotated by the second rotor around the second motor axis whereby the cleaning plate is driven with a second vibration in a second oscillating pattern parallel to the XY plane, whereby the cleaning plate has the cleaning vibration formed by the combination of the first vibration and the second vibration, an attachment assembly for flexibly attaching the cleaning plate to the body plate under compression to permit the cleaning plate to vibrate relative to the body plate and to isolate the cleaning vibration from the body, wherein the attachment assembly includes, a plurality of compression devices connected between the cleaning plate and the body for urging the cleaning plate and the body toward each other, a plurality of rolling separators under pressure from the compression devices for separating the cleaning plate and the body plate, a connector attached to the body for receiving a member to move the machine in the XY plane.

18. The machine of claim 17 wherein the drive assembly has a height dimension, H, and the cleaning plate has a minimum treatment dimension, M_D and where the ratio H/M_D is less than 0.25.

19. A machine for treating a surface lying in an XY plane comprising, a body having a body plate, a cleaning plate located between the body plate and the XY plane, a drive assembly connected to the cleaning plate to drive the cleaning plate with a cleaning vibration in an oscillating pattern parallel to the XY plane, an attachment assembly for flexibly attaching the cleaning plate to the body plate under compression to permit the cleaning plate to vibrate relative to the body plate and to isolate the cleaning vibration from the body, the attachment assembly including, a plurality of compression devices connected between the cleaning plate and the body for urging the cleaning plate and the body toward each other, a plurality of rolling separators under pressure from the compression devices for separating the cleaning plate and the body plate, a connection device having one side for connecting to the cleaning plate and having another side for connecting to a cleaning pad.

* * * * *